US009694605B2

(12) United States Patent
Miyashita et al.

(10) Patent No.: US 9,694,605 B2
(45) Date of Patent: Jul. 4, 2017

(54) LIQUID EJECTING APPARATUS

(71) Applicant: Seiko Epson Corporation, Tokyo (JP)

(72) Inventors: Eiichi Miyashita, Nagano (JP); Takashi Akahane, Nagano (JP); Hiroki Nakashima, Nagano (JP); Satoshi Noda, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/993,849

(22) Filed: Jan. 12, 2016

(65) Prior Publication Data

US 2016/0121628 A1 May 5, 2016

Related U.S. Application Data

(60) Continuation of application No. 14/178,582, filed on Feb. 12, 2014, now Pat. No. 9,242,491, which is a (Continued)

(30) Foreign Application Priority Data

Sep. 27, 2004 (JP) ..... 2004-280159
Sep. 27, 2004 (JP) ..... 2004-280195
(Continued)

(51) Int. Cl.
*B41J 13/14* (2006.01)
*B41J 11/04* (2006.01)
*B41J 3/407* (2006.01)

(52) U.S. Cl.
CPC ..... *B41J 11/04* (2013.01); *B41J 3/4071* (2013.01); *B41J 13/14* (2013.01)

(58) Field of Classification Search
CPC ..... B41J 3/4071; B41J 2/01; B41J 2/15; B41J 13/14
(Continued)

(56) References Cited

U.S. PATENT DOCUMENTS 5,241,353 A 8/1993 Maeshima et al.
5,297,018 A 3/1994 Kashimura
(Continued)

FOREIGN PATENT DOCUMENTS

EP 1 380 433 A2 1/2004
EP 1 389 535 A1 2/2004
(Continued)

OTHER PUBLICATIONS

U.S. Appl. No. 11/236,944, filed Sep. 27, 2005, Liquid Ejecting Apparatus.
(Continued)

*Primary Examiner* — Geoffrey Mruk
*Assistant Examiner* — Scott A Richmond
(74) *Attorney, Agent, or Firm* — Nutter McClennen & Fish LLP; John J. Penny, Jr.

(57) ABSTRACT

A liquid ejecting head is adapted to eject liquid toward a target medium. A transporter is adapted to transport a tray on which the target medium is mounted toward a region facing the liquid ejecting head via a transporting path. A tray guide is disposed in a front side of the liquid ejecting apparatus, and having a supporting face adapted to support the tray thereon. The tray guide is movable between a first position connecting the supporting face with the transporting path to allow the transporter to transport the tray to the transporting path and a second position escaping the supporting face from the transporting path. The supporting face is kept being parallel to the transporting path when the tray guide is moved between the first position and the second position.

7 Claims, 31 Drawing Sheets

Related U.S. Application Data continuation of application No. 13/618,777, filed on Sep. 14, 2012, now abandoned, which is a continuation of application No. 13/284,488, filed on Oct. 28, 2011, now Pat. No. 8,292,424, which is a continuation of application No. 12/150,830, filed on Apr. 30, 2008, now Pat. No. 8,070,284, which is a division of application No. 11/236,944, filed on Sep. 27, 2005, now Pat. No. 7,740,348.

(30) Foreign Application Priority Data

Sep. 27, 2004 (JP) ..... 2004-280725
Sep. 27, 2004 (JP) ..... 2004-280728

(58) Field of Classification Search
USPC ..... 347/104, 105, 101
See application file for complete search history.

(56) References Cited

U.S. PATENT DOCUMENTS

| | | | |
|---|---|---|---|
| 5,384,760 | A | 1/1995 | Kumakura |
| 6,148,722 | A | 11/2000 | Hagstrom |
| 6,332,680 | B1 | 12/2001 | Ozawa |
| 6,612,762 | B1 | 9/2003 | Sakurai et al. |
| 6,854,843 | B2 | 2/2005 | Anami et al. |
| 6,871,949 | B2 | 3/2005 | Nakano et al. |
| 7,101,096 | B2 | 9/2006 | Sasai et al. |
| 7,137,698 | B2 | 11/2006 | Miyake et al. |
| 7,547,099 | B2 | 6/2009 | Miyake et al. |
| 7,651,087 | B2 | 1/2010 | Miyashita et al. |
| 7,740,348 | B2 | 6/2010 | Miyashita et al. |
| 8,070,284 | B2 | 12/2011 | Miyashita et al. |
| 8,292,424 | B2 | 10/2012 | Miyashita et al. |
| 2003/0052956 | A1 | 3/2003 | Katsuyama |
| 2004/0041853 | A1* | 3/2004 | Takahashi ..... B41J 3/4071 347/5 |
| 2004/0041880 | A1* | 3/2004 | Ikeda ..... B41J 3/4071 347/37 |
| 2004/0066444 | A1 | 4/2004 | Anami et al. |
| 2004/0141787 | A1* | 7/2004 | Inokuchi ..... B41J 3/4071 400/582 |
| 2005/0151782 | A1 | 7/2005 | Ishida et al. |
| 2005/0225622 | A1 | 10/2005 | Anami et al. |
| 2006/0181566 | A1 | 8/2006 | Miyashita et al. |
| 2008/0001995 | A1 | 1/2008 | Umeda |
| 2009/0207227 | A1 | 8/2009 | Miyashita et al. |
| 2012/0044311 | A1 | 2/2012 | Miyashita et al. |
| 2013/0002780 | A1 | 1/2013 | Miyashita et al. |
| 2013/0010044 | A1 | 1/2013 | Miyashita et al. |

FOREIGN PATENT DOCUMENTS

| | | | |
|---|---|---|---|
| JP | 2003-112458 | A | 4/2003 |
| JP | 2003-211757 | A | 7/2003 |
| JP | 2004-074667 | A | 3/2004 |
| JP | 2004-130774 | A | 4/2004 |

OTHER PUBLICATIONS

U.S. Appl. No. 12/150,830, filed Apr. 30, 2008, Liquid Ejecting Apparatus.
U.S. Appl. No. 13/284,488, filed Oct. 28, 2011, Liquid Ejecting Apparatus.
U.S. Appl. No. 13/618,715, filed Sep. 14, 2012, Liquid Ejecting Apparatus.
U.S. Appl. No. 13/618,777, filed Sep. 14, 2012, Liquid Ejecting Apparatus.
U.S. Appl. No. 14/178,582, filed Feb. 12, 2014, Liquid Ejecting Apparatus.
European Search Report for Application EP 05021021.0, dated Dec. 4, 2006 (7 pages).

* cited by examiner

LIQUID EJECTING APPARATUS

This application is a continuation of U.S. application Ser. No. 14/178,582, filed Sep. 14, 2012, which is a continuation of U.S. application Ser. No. 13/618,777, filed Sep. 14, 2012, now abandoned, which is a continuation of U.S. application Ser. No. 13/284,488, filed on Oct. 28, 2011, now U.S. Pat. No. 8,292,424, which is a continuation of U.S. application Ser. No. 12/150,830, filed on Apr. 30, 2008, now U.S. Pat. No. 8,070,284, which is a division of U.S. application Ser. No. 11/236,944, filed on Sep. 27, 2005, now U.S. Pat. No. 7,740,348, whose priority is claimed from Japanese Patent Application Nos. 2004-280159 filed on Sep. 27, 2004, 2004-280195 filed on Sep. 27, 2004, 2004-280725 filed on Sep. 27, 2004, and 2004-280728 filed on Sep. 27, 2004, the contents of which are hereby incorporated by reference in their entirety.

BACKGROUND OF THE INVENTION

The present invention relates to a liquid ejecting apparatus which ejects liquid toward a target medium, and more particularly, to a liquid ejecting apparatus, configured to transport a tray in which the target medium such as an optical disc or the like can be set.

Here, the term "liquid ejecting apparatus" is used for referring not only to a recording apparatus, such as a printer, a copier, and a facsimile machine, having an ink jet recording head for ejecting ink from the recording head so as to perform recording on a recording medium but also to an apparatus that causes liquid to adhere onto a medium, corresponding to the recording medium in the above-described recording apparatus, by ejecting liquid selected depending on the use of the apparatus in place of ink onto the medium from a liquid ejecting head corresponding to the above-described ink jet recording head.

As the liquid ejecting head, the following heads can be considered other than the above-described recording head: a color-material ejecting head used for manufacturing a color filter for a liquid crystal display or the like, an electrode-material (conductive paste) ejecting head used for forming an electrode in an organic electroluminescent (EL) display or a field-emission display (FED), a bioorganic compound ejecting head used for manufacturing a bio-chip, and a sample spraying head as a precision pipette.

As examples of the recording apparatus and the liquid ejecting apparatus, an ink jet recording apparatus (hereinafter, referred to as a "printer") which directly ejects ink on a labeled surface of an optical disc, for example, a compact disc, thereby performing recording is used. That is, after the optical disc as a target medium is set on a tray formed of a plate body, the tray is transported into a medium transporting path by a transporting roller, and then recording is performed.

In such a printer, a guide member (attachment: hereinafter, referred to as "tray guide") for guiding the tray toward the front of the apparatus is detachably provided. Then, at the time of performing recording on the optical disc, the tray guide is installed, and the tray is sent from the tray guide inside the apparatus. Accordingly, the tray is transported to a recording start position by the transporting roller while being supported on the tray guide (for example, see Japanese Patent Publication No. 2003-211757A).

Further, an ejecting roller provided on a downstream of a recording head generally has a driving roller that is driven to be rotated and a follower roller that is brought into contact with the driving roller to be rotated by the driving roller. As the follower roller, a spur roller which has a serrated circumference is used in order to prevent dot omission or ink transport. However, there is an optical disc which has a data area just below a labeled surface, and thus, if the spur roller is pressed into contact with the labeled surface of such an optical disc, data of the optical disc may be destroyed. For this reason, in a recording apparatus which can perform recording on the optical disc, the follower roller and the driving roller are spaced apart from each other.

As an example of such a configuration, in Japanese Patent Publication No. 2004-130774A, a recording apparatus is disclosed in which a stacker for stacking sheets of paper to be ejected is displaceably provided between a first position and a second position so as to be used as a tray guide. According to this configuration, in connection with the position switching operation of the stacker, the follower roller can be displaced correspondingly, and the operation of the user can be simplified. In addition, the tray guide is integrally provided in the recording apparatus, and thus the tray guide does not need to be separately managed, thereby implementing a user-friendly apparatus.

Moreover, although the follower roller (the spur roller) is spaced apart from the driving roller, if the tray is elevated from a tray supporting face in the tray guide, the optical disc set on the tray may be brought into contact with the follower roller, and a data area of the optical disc may be damaged.

Accordingly, in order to prevent such a problem, in Japanese Patent Publication No. 2003-211757A, a tray is disclosed in which the distance from a set region of the optical disc in the tray to a leading end of the tray is made large. In this case, when the tray is sent in the transporting path from the downstream of the follower roller toward the upstream, the optical disc and the follower roller do not face each other until the leading end of the tray is nipped by the transporting rollers on the upstream of the recording head. According to this configuration, in a state in which the leading end of the tray is not nipped by the transporting rollers, that is, in a state in which the tray is easily elevated from the tray guide, the optical disc and the follower roller do not face each other, and thus the optical disc can be prevented from being brought into contact with the follower roller.

However, in the conventional configurations described above, the following four problems occur.

First, in order to switch the stacker described in Japanese Patent Publication No. 2004-130774A from the second position (a position for stacking sheets of paper) to the first position (a position for guiding the tray), the stacker in a substantially horizontal posture is rotated to be in a vertical posture once, is lifted upward, and then is rotated to be in the substantially horizontal posture again. The switching operation from the first position to the second position is performed in reverse order. However, it may be hard for the user to understand such an operation. Further, in order to rotate and moves vertically the stacker, a space of the recording apparatus in its heightwise direction needs to be provided.

Second, if the size of the tray is made such that the optical disc set on the tray is not brought into contact with the follower roller, as described above, the size of the printer in its depthwise direction is made large or the leading end of the tray projects to the rear side of the printer at the time of performing recording on the optical disc, which causes a problem in that the installment space in the rear side of the printer needs to be made large.

In addition, recently, for the sake of enhancing a throughput, the recording head tends to be made large. In this case, however, the medium transporting path from the transporting roller to the ejecting roller is elongated, and the length of the tray needs to be further lengthened accordingly, such that the above-described problem occurs more drastically. In addition, even when the follower roller is spaced apart from the driving roller and the follower roller is caused to slide along paper ejecting direction, the medium transporting path from the transporting roller to the ejecting roller is elongated, and thus the above-described problem occurs more drastically.

Third, in a state in which the tray is supported by the tray guide, if the position switching operation of the tray guide is executed, the optical disc set on the tray may be brought into contact with the spur roller, and thus the data area may be damaged. Further, if larger force than is necessary is applied and a compulsive position switching operation is performed, the optical disc set on the tray or the tray itself may be damaged.

Fourth, in order to cause the follower roller and the driving roller to be spaced apart from each other, a roller supporting frame for supporting the rotary shaft of the follower roller can be configured to slide in the medium transporting direction. With such a configuration, the size of the apparatus in its heightwise direction can be reduced, without needing the vertical space of the apparatus.

However, since the roller supporting frame has a shape which is long in a widthwise direction of the target medium, if the roller supporting frame is configured to slide in a direction perpendicular to the widthwise direction, that is, in the medium transporting direction, the posture of the roller supporting frame may be easily inclined at the time of the sliding operation, and thus a smooth sliding operation may not be performed. In addition, the sliding operation may be difficult.

SUMMARY OF THE INVENTION

It is therefore an object of the invention to provide a liquid ejecting apparatus in which a switching operation of a tray guide between positions is simplified, thereby further enhancing operability and reducing a size of the apparatus in its heightwise direction.

It is also an object of the invention to prevent a liquid ejecting apparatus from being enlarged or an installment space of the apparatus from being expanded, and to reliably prevent a target medium from being brought into contact with a follower roller of an ejecting roller.

It is also an object of the invention to provide a liquid ejecting apparatus which can prevent an optical disc set on a tray or a tray from being damaged, even when an erroneous operation is performed, in a state in which the tray is supported by a tray guide.

It is also an object of the invention to provide a liquid ejecting apparatus in which a roller supporting frame is allowed to stably slide when the roller supporting frame is configured to slide in a medium transporting direction.

In order to achieve the above objects, according to the invention, there is provided a liquid ejecting apparatus, comprising:

a liquid ejecting head, adapted to eject liquid toward a target medium;

a transporter, adapted to transport a tray on which the target medium is mounted toward a region facing the liquid ejecting head via a transporting path; and a tray guide, disposed in a front side of the liquid ejecting apparatus, and having a supporting face adapted to support the tray thereon, the tray guide being movable between a first position connecting the supporting face with the transporting path to allow the transporter to transport the tray to the transporting path and a second position escaping the supporting face from the transporting path, wherein the supporting face is kept being parallel to the transporting path when the tray guide is moved between the first position and the second position.

With this configuration, the displacement movement of the tray guide can be simplified, operability of the tray guide can be enhanced, and the size of the apparatus in its heightwise direction can be reduced.

The tray guide may be moved between the first position and the second position while being slid in a direction that the transporting path extends.

The tray guide may be situated above the transporting path when the tray guide is placed in the second position. In this case, a path for ejecting the medium, such as normal paper or the like, can be prevented from being complicated, without being influenced by the tray guide when such a medium is ejected.

The supporting face may extend horizontally. In this case, the size of the apparatus in its heightwise direction can be further reduced, without needing a space in the heightwise direction of the liquid ejecting apparatus.

The liquid ejecting apparatus may further comprise a tray guide retainer operable to retain the tray guide at either the first position or the second position and to guide the movement of the tray guide between the first position and the second position. The tray guide may be moved to the second position by pushing the tray guide retained in the first position toward a rear side of the liquid ejecting apparatus. The guide member may release the tray guide when the tray guide retained in the second position is pushed toward the rear side of the liquid ejecting apparatus.

In this case, the tray guide can be switched from the second position to the first position by performing a push-on operation, and thus an operation is simple and intelligible, thereby implementing a user-friendly apparatus.

Here, the tray guide retainer may comprise:

a first guide pin, project outward from each of both widthwise ends of the tray guide;

a guide member, disposed adjacent to each of both widthwise ends of the tray guide, and formed with a first groove extending in a direction that the tray guide moves and adapted to movably receive the first guide pin;

an urging member, urging the first guide pin in such a direction that the tray guide is moved to the first position; and a cam unit, fitted with the first guide pin such that the first guide pin is retained at a third position corresponding to the second position of the guide tray, and such that the first guide pin is released from the third position when the tray guide retained in the second position is pushed toward the rear side of the liquid ejecting apparatus.

In this case, when being displaced from the second position to the first position, the tray guide receives urging force of the urging member, and thus the operation when the tray guide is switched from the second position to the first position can be easily performed with a small load.

Here, the cam unit may comprise: a rotatable cam, formed with a slot to which the first guide pin is idly fitted, and a cam groove having a bottom formed with a stepped portion; and a pin member, configured to be movable along the cam groove while being urged toward the bottom of the cam groove. The pin member may be anchored by the stepped portion when the tray guide is retained in the second position.

In this case, the configuration for switching the position of the tray guide by a so-called push-on operation can be easily obtained with a simple structure.

Meanwhile, the liquid ejecting apparatus may further comprise an ejector, adapted to eject the target medium to the outside of the liquid ejecting apparatus. The ejector may comprise: a first roller and a second roller, adapted to nip the target medium therebetween; and a frame member, supporting the second roller, and interlocked with the tray guide so as to be movable between a fourth position allowing the second roller to be brought into contact with the first roller and a fifth position separating the second roller from the first roller. The frame member may be moved from the fourth position to the fifth position when the tray guide is moved from the second position to the first position. The frame member may be moved from the fifth position to the fourth position when the tray guide is moved from the first position to the second position.

In this case, when liquid is ejected onto the medium, such as an optical disc or the like, a data area can be reliably prevented from being broken since the second roller is pressed into contact with a surface of the medium, onto which liquid is to be ejected. Further, a user does not need to perform a special operation, thereby implementing a user-friendly apparatus.

Here, the tray guide retainer may comprise: a second guide pin, projected outward from each of both widthwise ends of the frame member; a second groove, formed in the guide member so as to extend in a direction that the frame member moves, and adapted to movably receive the second guide pin; and a link member, linking the first guide pin and the second guide pin so as to interlock the frame member with the tray guide.

In this case, the tray guide and the frame member can be connected to each other while ensuring a degree of freedom in operation.

Here, the link member may be formed with a third groove adapted to movably receive the first guide pin and a fourth groove adapted to movably receive the second guide pin. The third groove may be an L-shaped groove having a first portion extending parallel with the transporting path and a second portion extending the direction that the frame member moves. The fourth groove may extend in the direction that the frame member moves.

In this case, the tray guide and the frame member are connected one to one by the third and fourth guide grooves formed in the link member. Further, with the third guide groove, a latch stroke of the cam can be ensured, when the tray guide is retained at the second position or when the retained state of the tray guide at the second position is released. That is, only the tray guide can be displaced, without displacing the frame member.

Meanwhile, the tray guide may comprise: a shaft member, extending in a direction perpendicular to a direction that the transporting path extends; and a pinion gear, provided on each of ends of the shaft member. The tray guide retainer may comprise racks each of which is adapted to mesh with the pinion gear and extends in a direction parallel to the direction that the transporting path extends.

In this case, the tray guide can maintain a stable posture so as not to obliquely move at the time of the sliding operation.

The tray guide may have a back face opposite to the supporting face and adapted to face an ejecting path through which the target medium is ejected to the outside of the liquid ejecting apparatus, when the tray guide is placed in the second position. The back face may be formed with ribs extending in a direction that the target medium is ejected and adapted to guide side edges of the target medium.

In this case, when the target medium is ejected, there is no case in which the side edges of the target medium is caught on the tray guide, and thus the target medium can be smoothly ejected.

The liquid ejecting apparatus may further comprise a scanner unit disposed above the transporting path.

According to the invention, there is also provided a liquid ejecting apparatus, comprising:

a liquid ejecting head, adapted to eject liquid toward a target medium;

an ejector, adapted to eject the target medium to the outside of the liquid ejecting apparatus via a transporting path, the ejector comprising a first roller and a second roller which are adapted to nip the target medium therebetween, and are configured such that the second roller is movable between a first position being brought into contact with the first roller and a second position being separated from the first roller;

a transporter, adapted to transport a tray on which the target medium is mounted toward a region facing the liquid ejecting head via the transporting path;

a tray guide, disposed in a downstream part of the transporting path relative to the ejector, and having a supporting face adapted to support the tray thereon; and at least one regulator, disposed between the second roller and an end of the tray guide closer to the ejector, and operable to regulate a position of the tray in a direction orthogonal to the transporting path when the second roller is placed in the second position.

With this configuration, the target medium set on the tray can be reliably prevented from being brought into contact with the second roller. Further, the length of the tray does not need to be made large, and thus the liquid ejecting apparatus can be prevented from being enlarged or the installment space of the rear side of the liquid ejecting apparatus can be prevented from being expanded.

The second roller may be escaped from the transporting path when the second roller is placed in the second position. The regulator may project into the transporting path when the second roller is placed in the second position.

In this case, the regulator can be configured with a simple structure at low cost, and the target medium can be reliably prevented from being brought into contact with the second roller.

A plurality of regulators may be arranged in a widthwise direction of the tray guide. In this case, the target medium can be more reliably prevented from being brought into contact with the second roller.

The regulator may be arranged so as not to face the target medium mounted on the tray. In this case, the regulator is disposed at the position away from the target medium set on the tray. Therefore, the target medium can be prevented from being brought into contact with the second roller, such that there is no case in which the target medium is damaged.

The regulator may be retracted from the transporting path when the second roller is placed in the first position. In this case, when liquid is ejected onto the target medium such as normal paper or the like, there is no case in which the regulator interrupts the ejection of the target medium.

The tray guide may be movable between a third position connecting the supporting face with the transporting path to allow the transporter to transport the tray to the transporting path and a fourth position escaping the supporting face from the transporting path. The second roller may be moved from the first position to the second position when the tray guide is moved from the fourth position to the third position. The second roller may be moved from the second position to the first position when the tray guide is moved from the third position to the fourth position.

In this case, it is not necessary to remove the tray guide from the liquid ejecting apparatus and to manage separately, thereby implementing a user-friendly apparatus.

In addition, since the regulator is moved in accordance with the movement of the tray guide, operability can be enhanced. Further, since the regulator reliably projects into the transporting path when the tray is subjected to the transportation, the contact between the second roller and the tray can be reliably avoided.

According to the invention, there is also provided a liquid ejecting apparatus, comprising:

a liquid ejecting head, adapted to eject liquid toward a target medium;

a transporter, adapted to transport a tray on which the target medium is mounted toward a region facing the liquid ejecting head via a transporting path; and a tray guide, disposed in a front side of the liquid ejecting apparatus, and having a supporting face adapted to support the tray thereon, the tray guide being movable between a first position connecting the supporting face with the transporting path to allow the transporter to transport the tray to the transporting path and a second position escaping the supporting face from the transporting path; and a locker, operable to lock the tray guide at the first position.

With this configuration, even when the position switching operation of the tray guide is executed in a state in which the tray is supported, by locking the tray guide at the first position, the position of the tray guide does not change, and thus the target medium or the tray can be protected.

The locker may automatically lock the tray guide when the tray is mounted on the tray guide placed in the first position.

In this case, even when the position switching operation of the tray guide is executed in a state in which the tray is supported, the position of the tray guide does not change, and thus the target medium or the tray can be protected. Further, the tray guide is locked at the first position with no additional operation so that, a user-friendly apparatus can be implemented.

Here, the locker may comprise:

a locking member, comprising a first projection extending in a first direction and a second projection extending in a second direction opposite to the first direction, the locking member slidably provided on the tray guide such that the first projection is retractably projected into the supporting face;

an urging member, urging the locking member toward the supporting face; and a frame member, disposed adjacent to a side end of the tray guide and formed with a first hole.

The first projection may be retracted from the supporting face by the tray mounted on the tray guide so that the locking member is slid against an urging force of the urging member, thereby inserting the second projection into the first hole. In this case, the locker can be configured with a simple structure at low cost.

The tray guide may be formed with a second hole opposing the first hole. The locking member may comprise a third projection being inserted into the second hole.

In this case, the tray guide and the frame member engage with each other to be close to each other. As a result, the tray guide can be tightly, not unsteadily, locked at the first position.

According to the invention, there is provided a liquid ejecting apparatus, comprising:

a liquid ejecting head, adapted to eject liquid toward a target medium;

an ejector, adapted to eject the target medium to the outside of the liquid ejecting apparatus via a transporting path, the ejector comprising:

a first roller and a second roller, adapted to nip the target medium therebetween; and a frame member, supporting the second roller, and slidable between a first position allowing the second roller to be brought into contact with the first roller and a second position separating the second roller from the first roller; and a plurality of urging members, arranged symmetrically with a longitudinal center of the frame member and urging the frame member toward the first position.

With this configuration, even when the sliding operation is obliquely performed, the frame member returns to the original posture by the urging members. As a result, the frame member can smoothly perform the sliding operation while maintaining the stable posture.

The urging members may be arranged at both longitudinal end portions of the frame member. In this case, the posture of the frame member can be more reliably stabilized.

The liquid ejecting apparatus may further comprise:

a transporter, adapted to transport a tray on which the target medium is mounted toward a region facing the liquid ejecting head via the transporting path; and a tray guide, disposed in a downstream part of the transporting path relative to the ejector, and having a supporting face adapted to support the tray thereon, the tray guide being movable between a third position connecting the supporting face with the transporting path to allow the transporter to transport the tray to the transporting path and a fourth position escaping the supporting face from the transporting path, The urging members may be provided on the tray guide such that the frame member is urged when the tray guide is placed in the fourth position.

In this case, when the tray guide is switched from the fourth position to the third position, the urging force operates to urge the tray guide toward the third position. Therefore, the position switching operation of the tray guide can be easily performed with small force.

Each of the urging members may comprise: a lever member, being slidable in a direction that the frame member slides; and a coiled spring, urging the lever member toward the frame member.

In this case, the urging members can be configured with a simple structure at low cost.

BRIEF DESCRIPTION OF THE DRAWINGS

The above and other features and advantages of the present invention will become more apparent from the following description of the presently preferred exemplary embodiments of the invention taken in conjunction with the accompanying drawings, in which.

DESCRIPTION OF THE PREFERRED EMBODIMENTS

Embodiments of the invention will be described below in detail with reference to the accompanying drawings.

First, the overall configuration of an ink jet printer 1 (hereinafter, referred to as "printer"), which is an example of "a recording apparatus", or "a liquid ejecting apparatus" according to one embodiment of the present invention will be described with reference to FIGS. 1 to 3.

The printer 1 has a scanner unit (not shown) in its upper portion, that is, serves as a scanner-integrated-type printer, such that an image read by the scanner unit can be recorded by a recording apparatus described below (hereinafter, the description of the scanner unit will be omitted). Accordingly, as described below, the printer 1 is studied in order to suppress the size of the apparatus in the heightwise direction to be small. Further, the printer 1 has an interface (not shown), which can be connected to an external host computer, and a slot (not shown) into which a recording medium, such as a memory card or the like, is installed. Then, the printer 1 also serves as a so-called stand-alone printer in which image data or the like held in the recording medium is directly read, and image data is directly recorded in the recording medium by the recording apparatus described below.

Figure 3:
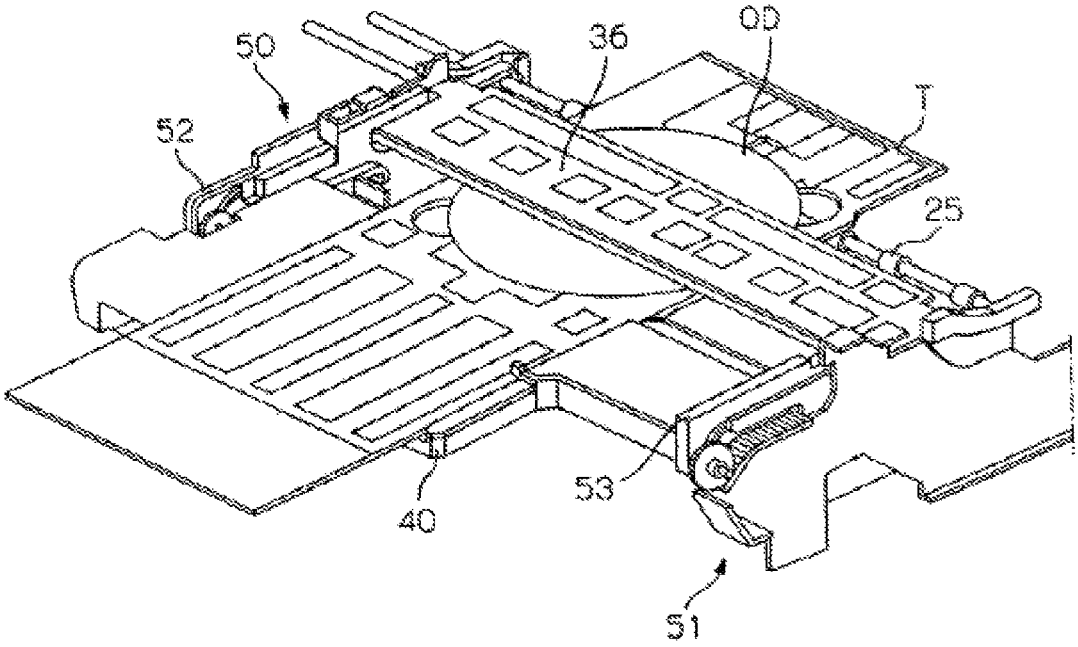
FIG. 3 is a perspective view of a part of a front section of the printer.

In addition, as shown in FIG. 3, the printer 1 is configured to transport a tray T on which an optical disc OD as a "target medium" to which liquid is to be ejected can be set. The tray T is formed of a plate body, and is guided by a tray guide 40 to a transporting path (hereinafter, referred to as "medium transporting path") for transporting paper P which is an example of the target medium. Then, while the tray T is transported on the medium transporting path by a transporter 2, ink jet recording is performed directly on a labeled surface of the optical disc OD.

Figure 1:
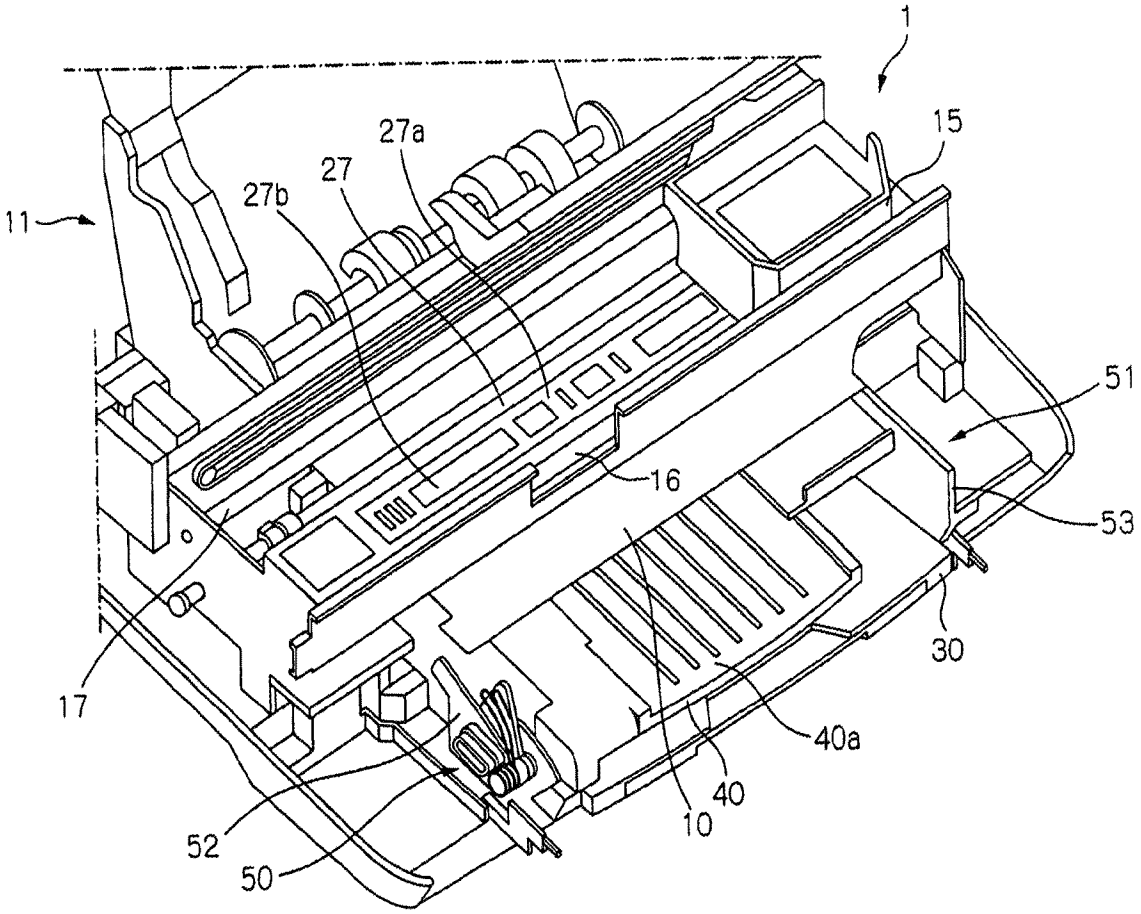
FIG. 1 is a perspective view of a printer according to one embodiment of the invention, showing a state that an upper housing is escaped.
Figure 2:
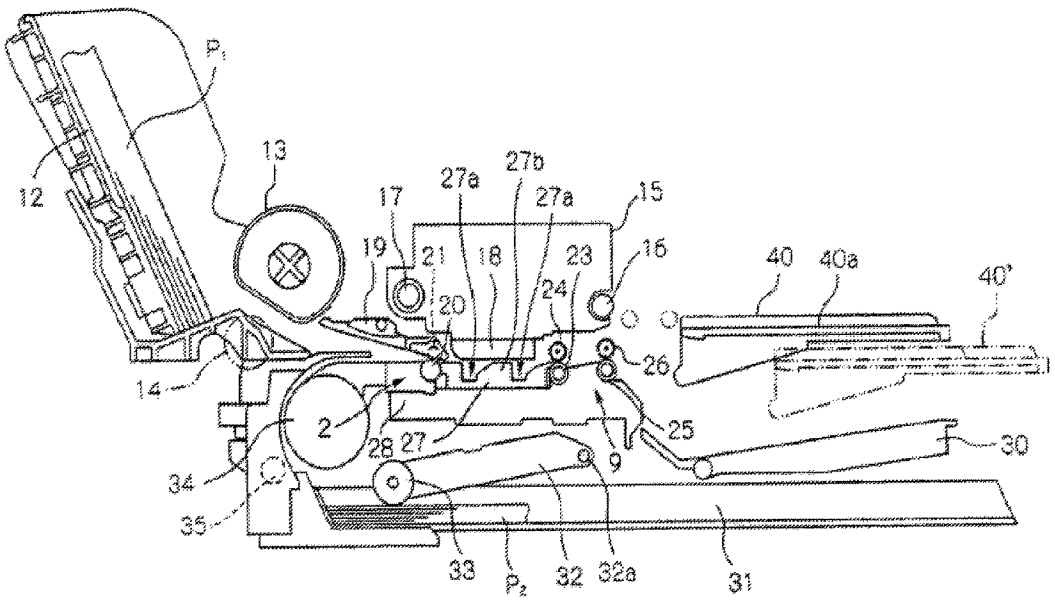
FIG. 2 is a schematic side section view of the printer.

As shown in FIG. 1, the tray guide 40 has a tray supporting face 40*a* for supporting the tray T and is provided to be displaced between a first position at which the tray T is guided to the medium transporting path (indicated by a phantom line and reference numeral 40' in FIG. 2) and a second position at which the tray T is escaped from the medium transporting path (indicated by a solid line FIG. 2). In the present embodiment, the tray T is configured to be substantially transported horizontally with respect to a depthwise direction of the printer 1 (a front-rear direction: a lateral direction in FIG. 2). Therefore, the tray supporting face 40*a* has a substantially horizontal face at the first position. Further, as described below in detail, when the medium transporting path is laterally viewed, the tray guide 40 is configured to be displaced between the first position and the second position while maintaining a posture along a transporting direction of the tray T.

Further, in the present embodiment, a photo-stand paper (paper which is processed to be mounted on a mounting surface on a standing posture after printing, like a photograph layout: not shown) can be guided from the tray guide 40 to the medium transporting path, like the tray T, and the photo-stand paper has the same size as that of the tray T in the widthwise direction. Therefore, in the tray supporting face 40*a* of the tray guide 40, a so-called edge guide to be displaced in the widthwise direction does not need to be provided.

Next, in FIGS. 1 and 3, reference numeral 51 denotes a tray guide retainer that holds the tray guide 40 at the first position and the second position and guides the tray guide 40 from the first position to the second position and from the second position to the first position. Further, reference numeral 50 denotes a tray guide retainer that holds the tray guide 40 at the first position and guides the tray guide 40 from the first position to the second position and from the second position to the first position. The descriptions of the tray guide retainers 50 and 51 will be described below in detail.

Subsequently, the medium transporting path of the printer 1 will be described in detail primarily with reference to FIG. 2. In the embodiment of the present invention, the medium transporting path is defined as a path from a driving roller 21 to be described below toward the downstream side (the right side of FIG. 2), that is, a substantially linear medium transporting path. Further, a path from the driving roller 21 toward the upstream side is referred to as "medium feeding path" so as to be distinguished from the medium transporting path.

The printer 1 has a automatic sheet feeder (ASF) 11 for setting paper P1 on an oblique posture in the rear side thereof and has paper feeding tray 31 for setting paper P2 on a horizontal posture in the bottom portion thereof. Hereinafter, when the paper P1 and the paper P2 do not need to be distinguished from each other, the paper P1 and the paper P2 are simply referred to as "paper P".

The automatic sheet feeder 11 has a hopper 12, a feeding roller 13, and a separating roller 14. The hopper 12 is provided to support the paper P1 on the oblique posture and pivots to switch between a state that presses the paper P1 into contact with the feeding roller 13 and a state that moves the paper P1 away from the feeding roller 13. The feeding roller 13 is D-shaped in side view, and rotates so as to feed the uppermost paper P1 pressed into contact with the feeding roller 13 toward the downstream side. The separating roller 14 is provided to be pressed into contact with the feeding roller 13, and predetermined rotation-resistive force is transmitted thereto. When double feeding of the paper P1 does not occur and the paper P1 is fed one by one, the separating roller 14 is rotated by the feeding roller 13. When plural sheets of paper P1 exist between the separating roller 14 and the feeding roller 13, a frictional coefficient between the sheets of paper is low, and thus the rotation of the separating roller 14 stops. With the operation of the separating roller 14, subsequent sheets of paper P1, which are attracted by the uppermost paper P1 to be double-fed, do not progress from the feeding roller 13 toward the downstream side and remain in a vicinity of a point at which the separating roller is pressed into contact with the feeding roller 13, such that double feeding of the paper is prevented.

On the downstream side of the automatic sheet feeder 11, the transporter 2 that has a driving roller 20 and a follower roller 21, and transports the paper P or the tray T to a region opposite to an ink jet recording head 18 is provided. The driving roller 20 is formed of a shaft body, which is elongated in a primary scanning direction, and is driven to be rotated by a driving motor (not shown). The follower roller 21 is rotatably supported by follower roller holders 19, which are provided in parallel over the primary scanning direction, and is pressed into contact with the driving roller 20 to be rotated by the driving roller 20. The paper P fed from the automatic sheet feeder 11 or the paper feeding tray 31 in the bottom portion of the printer 1 is nipped by the driving roller 20 and the follower roller 21, and is transported to the region opposite to the ink jet recording head 18 on the downstream side by the rotation of the driving roller 20.

On the downstream side of the driving roller 20 and the follower roller 21, the ink jet recording head 18 and a platen 27 constituting a recording section are provided to vertically face each other. The ink jet recording head 18 is provided in the bottom portion of a carriage 15, and ink droplets are ejected onto the paper P or the optical disc OD, together with a reciprocating operation of the carriage 15 in the primary scanning direction, such that recording is executed on a recording surface of the paper P or the optical disc OD. The carriage 15 is provided to be guided in the primary scanning direction by a main guide shaft 17 and an auxiliary guide shaft 16, which extend in the primary scanning direction, and is driven to reciprocate by a driving motor (not shown).

Moreover, the printer 1 according to the present embodiment is configured to supply ink from an ink cartridge provided in a side bottom portion (not shown) in front of the apparatus separately from the carriage 15, not on the carriage 15, to the ink jet recording head 18 via an ink supply tube (not shown).

As shown in FIG. 1, the platen 27 has a shape which extends in the primary scanning direction. The platen 27 has ribs that extend in the medium transporting direction and are provided by suitable gaps in the primary scanning direction. The platen 27 supports the paper P so as to define the distance between the paper P and the ink jet recording head 18. Further, in the platen 27, a concave portion 27*a* is formed at a position opposite to the ink jet recording head 18 (ink ejection nozzles).

In the concave portion 27*a* that is formed to extend in the primary scanning direction, island portions 27*b* are locally disposed over the primary scanning direction. With this configuration, ink ejected onto the front end and the rear end of the paper P, and portions distant from both side ends of the paper P having a predetermined size is discarded into the concave portion 27*a*, such that marginless printing is performed. In the concave portion 27*a*, an ink absorber (not shown) is provided to absorb ink to be discarded, and, in the bottom portion of the concave portion 27*a*, a hole (not shown) to be connected to the bottom face of the platen 27 is formed. Then, ink is guided to a waste liquid collector 28, which is provided in a lower portion of the platen 27, by the hole.

Next, on the downstream side of the ink jet recording head 18, an ejector 9 that has a first driving roller 23, a first follower roller 24, a second driving roller 25, and a second follower roller 26, is provided. The first driving roller 23 and the second driving roller 25 are driven to be rotated by a driving motor (not shown). Further, the first follower roller 24 is brought into contact with the first driving roller 23 to be rotated by the first driving roller 23, and the second follower roller 26 is brought into contact with the second driving roller 25 to be rotated by the second driving roller 25. Then, the paper P on which recording was performed is nipped by these rollers and is ejected to a stacker 30.

Here, the first follower roller 24 and the second follower roller 26 are rotatably provided in a roller supporting frame 36 (FIG. 3), which is formed of a metal plate material and has a shape extending in the primary scanning direction. In addition, the roller supporting frame 36 is configured to be displaced between a contact position that brings the first follower roller 24 into contact with the first driving roller 23 and brings the second follower roller 26 into contact with the second driving roller 25, and a release position that moves the first follower roller 24 and the second follower roller 26 away from the first driving roller 23 and the second driving roller 25, respectively.

That is, as the first follower roller 24 and the second follower roller 26 to be brought into contact with the printing surface of the paper P, a spur roller having a serrated circumference is used in order to prevent dot omission or ink transport. However, since the optical disc OD has a data area just below the labeled surface (the printing surface), if the first follower roller 24 or the second follower roller 26, which has the spur roller, is brought into contact with the labeled surface of the optical disc OD, the data area of the optical disc OD may be damaged. Therefore, at the time of performing printing on the optical disc OD, the roller supporting frame 36 is displaced to the release position, such that the data area of the optical disc OD is not damaged (the detailed description thereof will be described below).

Moreover, hereinafter, the term "release position" is used to include a position of the roller supporting frame 36 when the first follower roller 24 and the second follower roller 26 move away from the first driving roller 23 and the second driving roller 25, respectively, and positions of the first follower roller 24 and the second driving roller 25 at that time. Similarly, the term "contact position" is used to include a position of the roller supporting frame 36 when the first follower roller 24 and the second follower roller 26 are brought into contact with the first driving roller 23 and the second driving roller 25, respectively, and positions of the first follower roller 24 and the second driving roller 25 at that time.

In a front end of an upper portion of the feeding tray 31 provided in the bottom portion of the apparatus, a pickup roller 33 is provided. The pickup roller 33 is supported by a pivotable support member 32 around a pivot shaft 32*a* and is driven to be rotated by a driving motor (not shown). Then, with the pivot operation of the support member 32, the displacement is performed between a position to be brought into contact with the paper P2 set on the paper feeding tray 31 and a position to be moved away from the paper P2, and the rotation is done in a state of being brought into contact with the paper P2, such that the uppermost paper P2 is fed toward the rear side of the apparatus (a left direction of FIG. 2).

On the front end side of the feeding tray 31, an inverting roller 34 that is driven to be rotated by a driving motor (not shown) is provided, and a curved inversion feeding path of the paper P2 is formed around the inverting roller 34. At a position opposite to the inverting roller 34, a nipping roller 35 is displaceably provided between a position to be pressed into contact with the inverting roller 34 and a position to be moved away from the inverting roller 34. The paper P2 to be fed by the pickup roller 33 subsequently passes through a point that the inverting roller 34 is pressed into contact with the nipping roller 35, such that double feeding is prevented. Further, feeding force by the rotation of the inverting roller 34 is transmitted, and thus the paper P2 is further fed to the downstream side. Then, the paper P2 passes through the curved inversion feeding path around the inverting roller 34, is nipped by the driving roller 20 and the follower roller 21, like the paper P1 to be fed by the automatic sheet feeder 11, and is transported to the downstream side.

Next, the configurations of the tray guide retainers 50 and 51 will be described in detail with reference to FIGS. 4 to 24.

As shown in FIG. 1, the tray guide retainer 50 is provided on the left side of the tray guide 40, and the tray guide retainer 51 is provided on the right side of the tray guide 40. The tray guide retainer 50 has the guide member 52 that is provided upright on the left side of the tray guide 40, and the tray guide retainer 51 has a guide member 53 that is provided upright on the right side of the tray guide 40. With the guide members 52 and 53, the tray guide 40 is guided from the first position to the second position and from the second position to the first position. Further, similarly, the roller supporting frame 36 is guided from the contact position to the release position and from the release position to the contact position.

Figure 5:
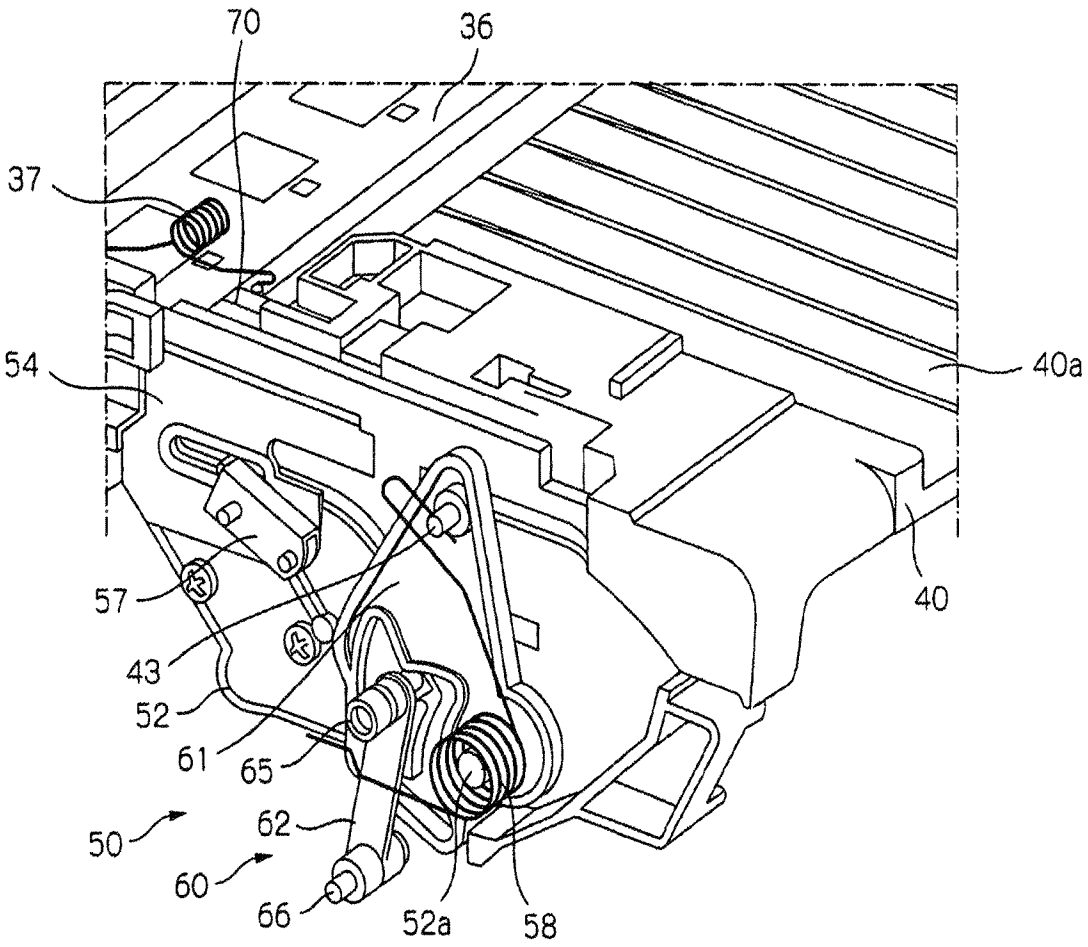
FIG. 5 is an enlarged perspective view of a left side of the front section.
Figure 6:
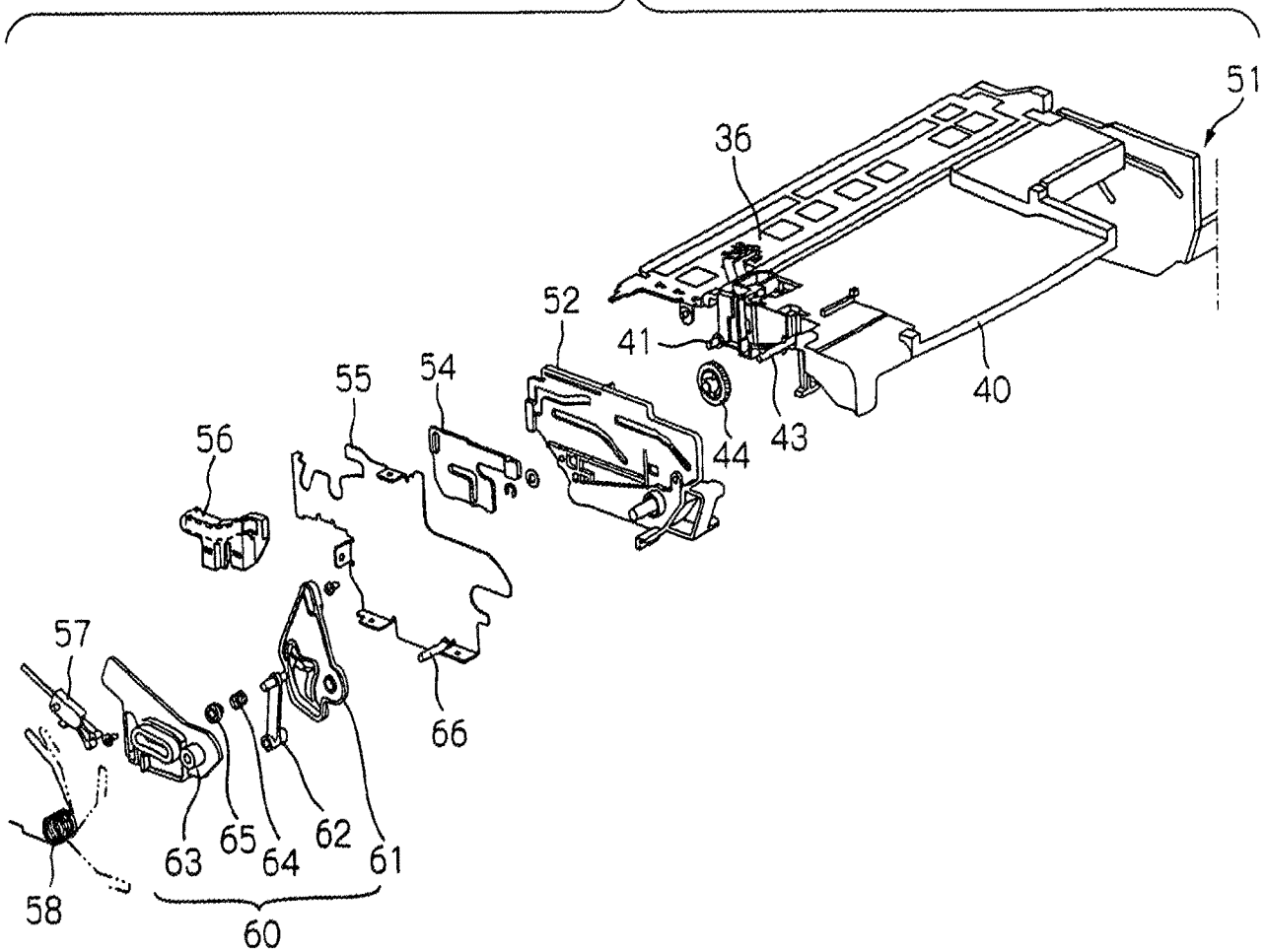
FIG. 6 is a perspective view showing a disassembled state of the left side of the front section.

Here, the tray guide retainer 50 has a cam unit 60, as shown in FIG. 5, in addition to the configuration of the tray guide retainer 51. The cam unit 60 holds the tray guide 40 at the second position and, when the tray guide 40 held at the second position is pressed toward the rear side of the printer 1, releases the held state at the second position. Therefore, hereinafter, the configuration of the tray guide retainer 50 will be described in detail. Moreover, the configuration of the tray guide retainer 51 has the same configuration of the tray guide retainer 50, except that the cam unit 60 is not provided.

As shown in FIGS. 5 to 11, the tray guide retainer 50 has a first guide pin 41, a shaft 43, a pinion gear 44, the guide member 52, a link member 54, a frame 55, a frame guide 56, the cam unit 60, a position detector 57, and a torsional coiled spring 58. Further, the cam unit 60 has a heart cam 61, a rod 62, a rod guide 63, a spring 64, and a slider 65.

Moreover, on both sides of the roller supporting frame 36, second guide pins 36*b* (FIG. 10), each of which projects outward (projects in the same direction as the projecting direction of the corresponding first guide pin 41 to be described below), are provided on the downstream side of the roller supporting frame 36. On the upstream side thereof, projections 36*a* are formed to project in the same direction as those of the second guide pins 36*b*. The second guide pins 36*b* and the projections 36*a* define a sliding path of the roller supporting frame 36.

Figure 11:
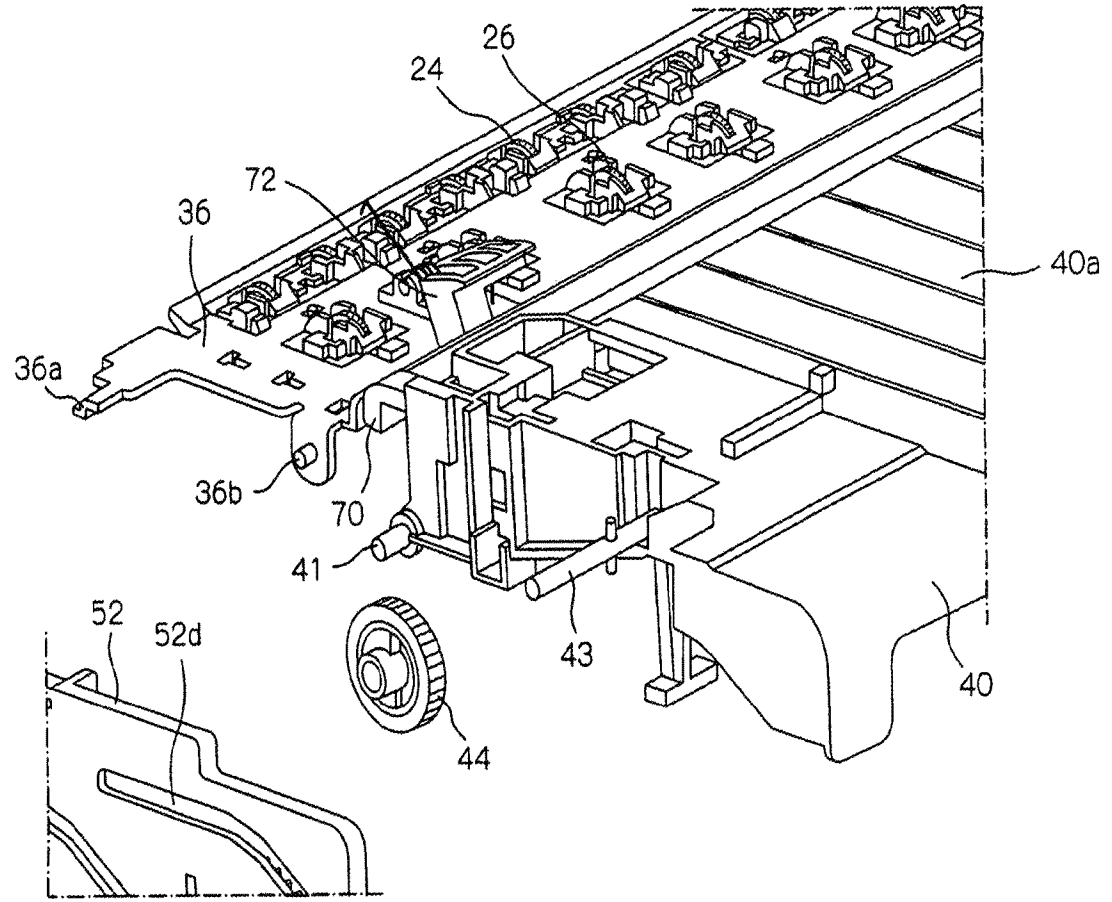

Hereinafter, the individual parts will be separately described. As shown in FIG. 11, the first guide pins 41 are provided so as to project outward from both sides of the tray guide 40, that is, in a direction (the widthwise direction of the tray guide 40: the direction perpendicular to the paper in FIG. 2) perpendicular to the sliding direction of the tray guide 40 (the longitudinal direction of the tray guide 40), which slides in the transporting direction of the tray T (the lateral direction in FIG. 2). In the assembled state of the tray guide retainer 50, the first guide pin 41 is idly inserted into a first guide groove 52*c*, which is formed in the guide member 52.

The shaft 43 is rotatably supported to extend in the direction perpendicular to the sliding direction of the tray guide 40 (the widthwise direction of the tray guide 40). Both ends of the shaft 43 are formed to project outward from both sides of the tray guide 40, like the first guide pins 41. Moreover, in the present embodiment, the end of the shaft 43 is idly inserted into a first guide groove 52*d* formed in the guide member 52, and has the same function as that of the first guide pin 41.

The pinion gear 44 is fitted to the end of the shaft 43 and, in the assembled state of the tray guide retainer 50, is interlocked with a rack 52*e* (see FIG. 12) formed in the guide member 52 so as to be rotated by the sliding operation of the tray guide 40.

Figure 10:
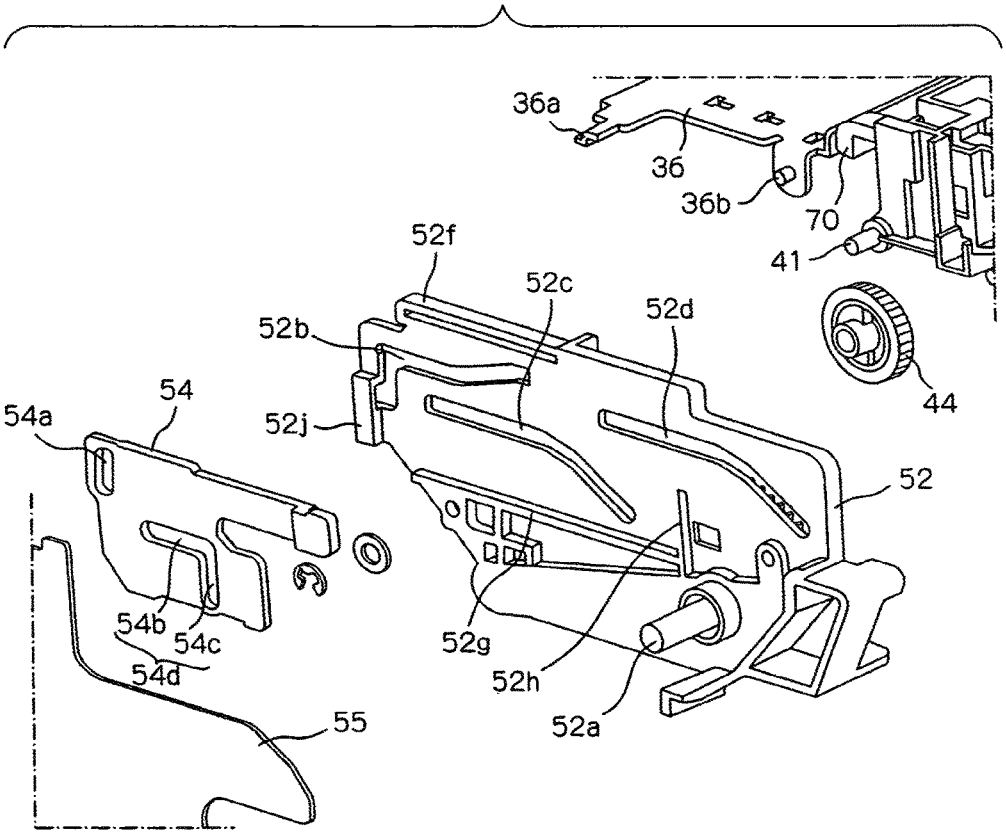
Figure 12:
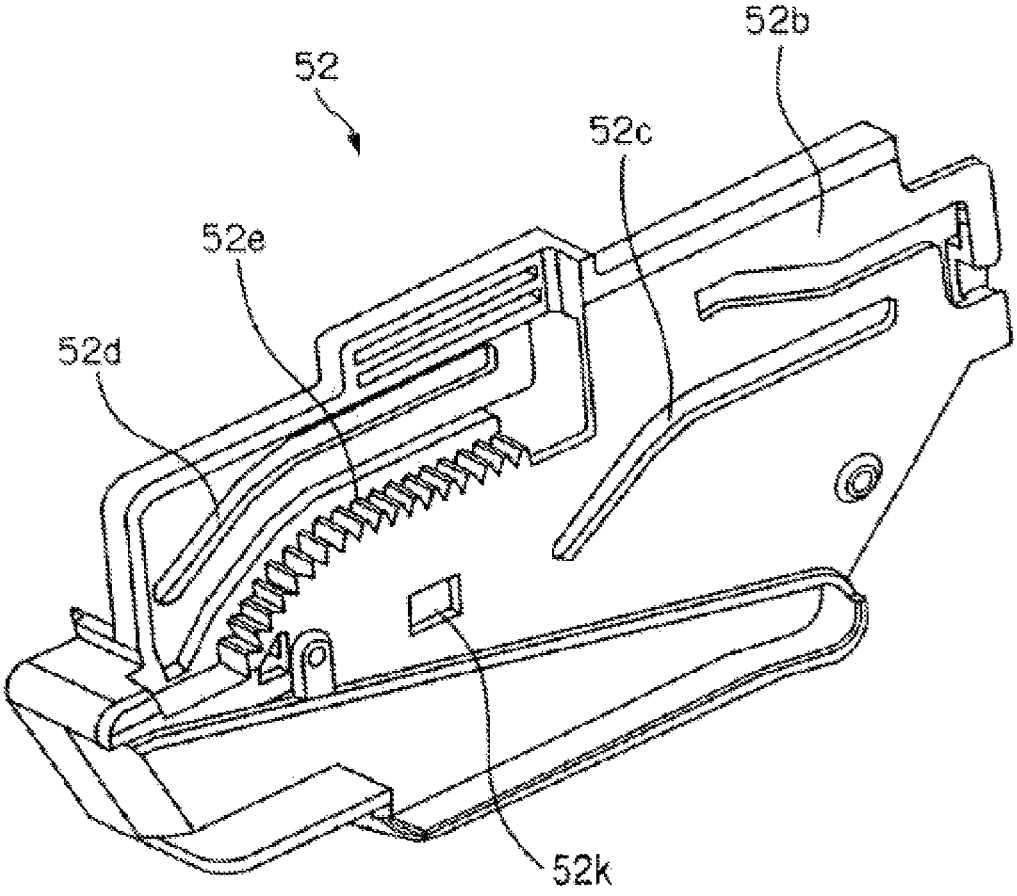
FIG. 12 is a perspective view of an inner side of a guide member shown in FIG. 6.

In FIG. 10, the guide members 52 are provided upright on both sides of the tray guide 40. Each guide member 52 has a plate shape, and is fixed to the frame 55 such that its plate surface is horizontal to the sliding direction of the tray guide 40 and is perpendicular to the tray supporting face 40*a*. In the guide member 52, the first guide grooves 52*c* and 52*d* (see FIG. 13), which extend in the displacement direction of the tray guide 40 (including a component of the transporting direction of the tray T and a component of a direction to approach or move away from the medium transporting path (the vertical direction of FIG. 2), are formed, and a second guide groove 52*b*, which extends in the displacement direction of the roller supporting frame 36 (including a component of the transporting direction of the tray T and a component of a direction to approach or move away from the medium transporting path (the vertical direction of FIG. 2), is formed. Further, on a face opposite to the side face of the tray guide 40, the rack 52*e* is formed to extend in the displacement direction of the tray guide 40 (FIG. 12). In addition, on an outer face, a shaft 52*a* is formed to project outward (in the same direction as the projecting direction of the first guide pin 41).

Figure 13:
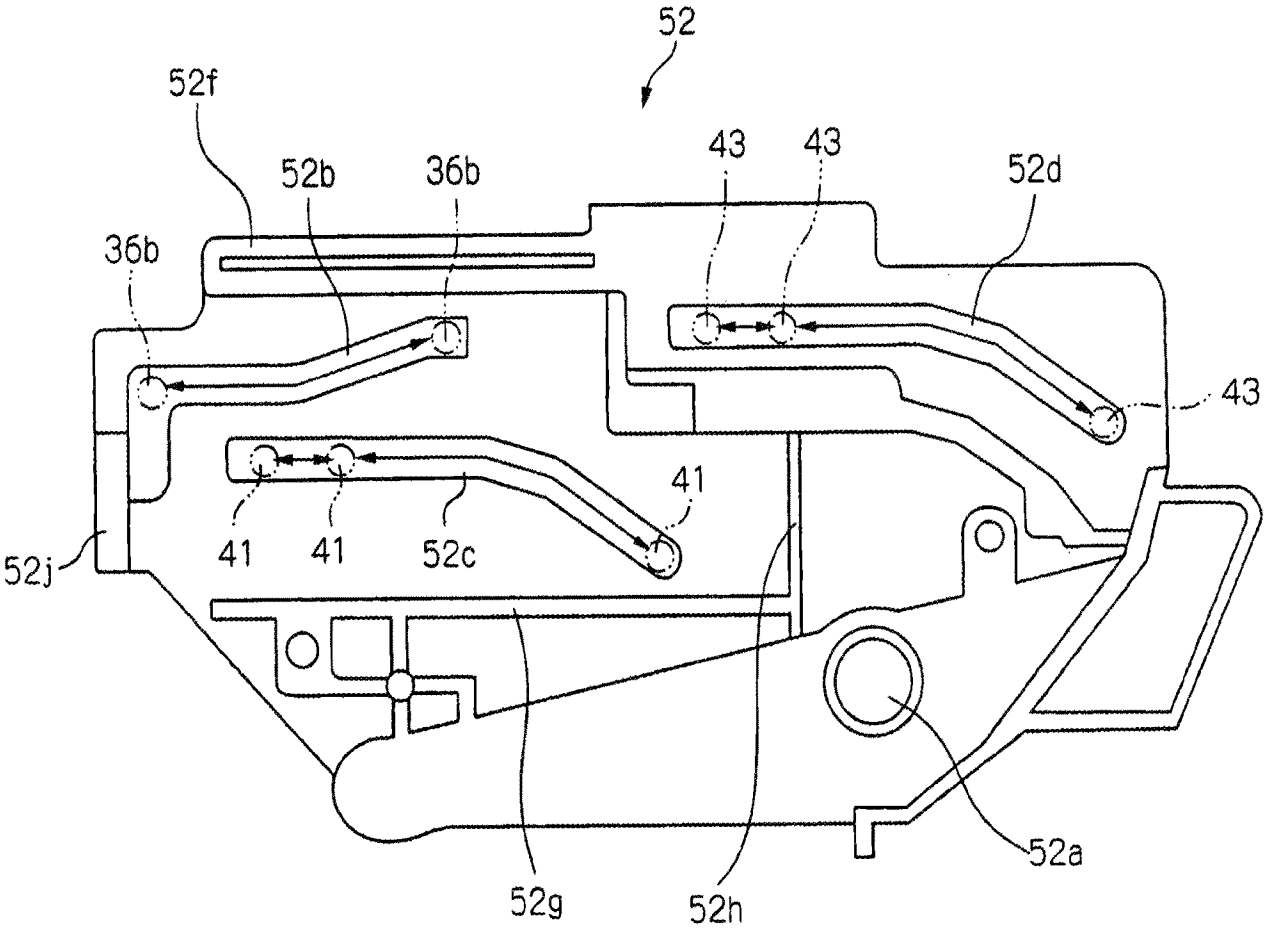
FIG. 13 is a plan view of an outer side of the guide member.

In the assembled state of the tray guide retainer 50, the first guide pin 41 is idly inserted into the first guide groove 52*c*, the shaft 43 is idly inserted into the first guide groove 52*d*, and the second guide pin 36*b* formed in the roller supporting frame 36 is idly inserted into the second guide groove 52*b*. Then, as shown in FIG. 13, according to the displacement operations of the tray guide 40 and the roller supporting frame 36, the first guide pin 41 moves in the first guide groove 52*c*, the shaft 43 moves in the first guide groove 52*d*, and the second guide pin 36*b* moves in the second guide groove 52*b*. Accordingly, the sliding paths of the tray guide 40 and the roller supporting frame 36 are defined.

The link member 54 has a plate shape, like the guide member 52, and is interposed between the guide member 52 and the frame 55. Further, in the guide member 52, guide portions 52*g* and 52*f* are formed to extend in the transporting direction of the tray T. Then, the link member 54 is fitted between the guide portions 52*g* and 52*f* so as to slide while being guided in the transporting direction of the tray T. Moreover, in the guide member 52, reference numerals 52*h* and 52*j* denote stopper portions, and the stopper portions 52*h* and 52*j* regulate the slide range of the link member 54.

In addition, in the link member 54, a third guide groove 54*d* and a fourth guide groove 54*a* are formed. Here, the third guide groove 54*d* is a guide groove that has a slot 54*b* extending in the operating direction of the tray guide 40 (the position switching direction; in the present embodiment, the direction in which the tray guide 40 is pressed toward the rear side of the printer 1, that is, the horizontal direction) when the tray guide 40 is held at the second position and when the held state at the second position is released, and a slot 54*c* extending in a direction to approach or move away from the medium transporting path (in the present embodiment, the vertical direction). The third guide groove 54*d* has an L shape, which is formed by crossing the slots 54*b* and 54*c* to each other. Further, the fourth guide groove 54*a* is a guide groove which extends in a direction in which the first follower roller 24 (the second follower roller 26) approaches or moves away from the first driving roller 23 (the second driving roller 25).

Figure 14:
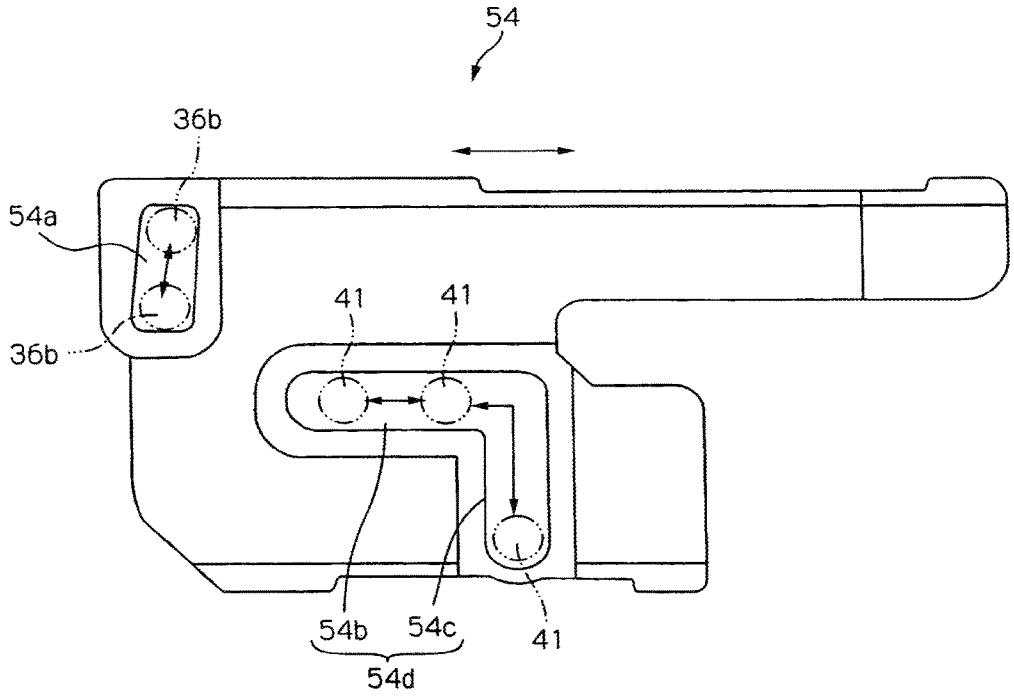
FIG. 14 is a plan view of a link member shown in FIG. 6.

In the assembled state of the tray guide retainer 50, the first guide pin 41 is idly inserted into the third guide groove 54*d*, and the second guide pin 36*b* is idly inserted into the fourth guide groove 54*a*. Accordingly, the tray guide 40 and the roller supporting frame 36 are connected to each other via the link members 54, and the roller supporting frame 36 is displaced, together with the tray guide 40. Moreover, at the time of the displacement operations of the tray guide 40 and the roller supporting frame 36, the first guide pin 41 and the second guide pin 36*b* moves in the first guide groove 52*c* and the second guide groove 52*b*, respectively, as described above with reference to FIG. 13, and moves in the third guide groove 54*d* and the fourth guide groove 54*a*, respectively, as shown in FIG. 14.

Figure 8:
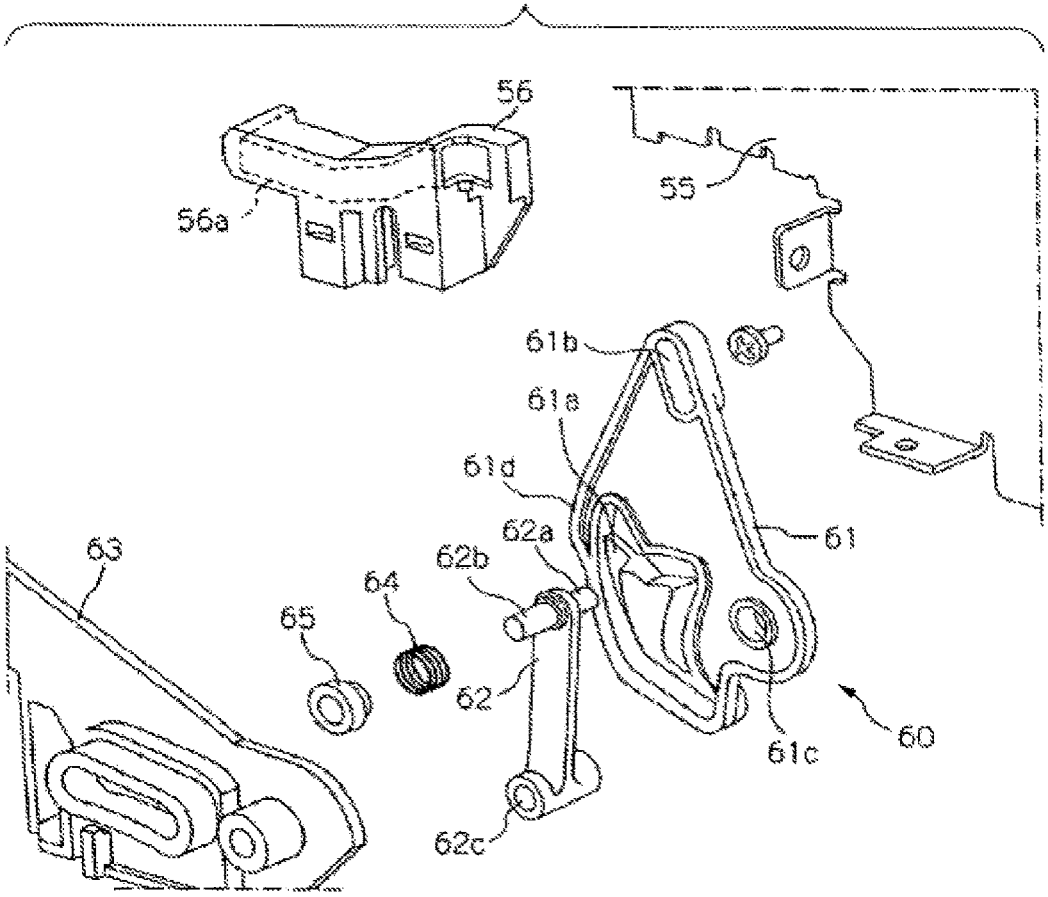
Figure 9:
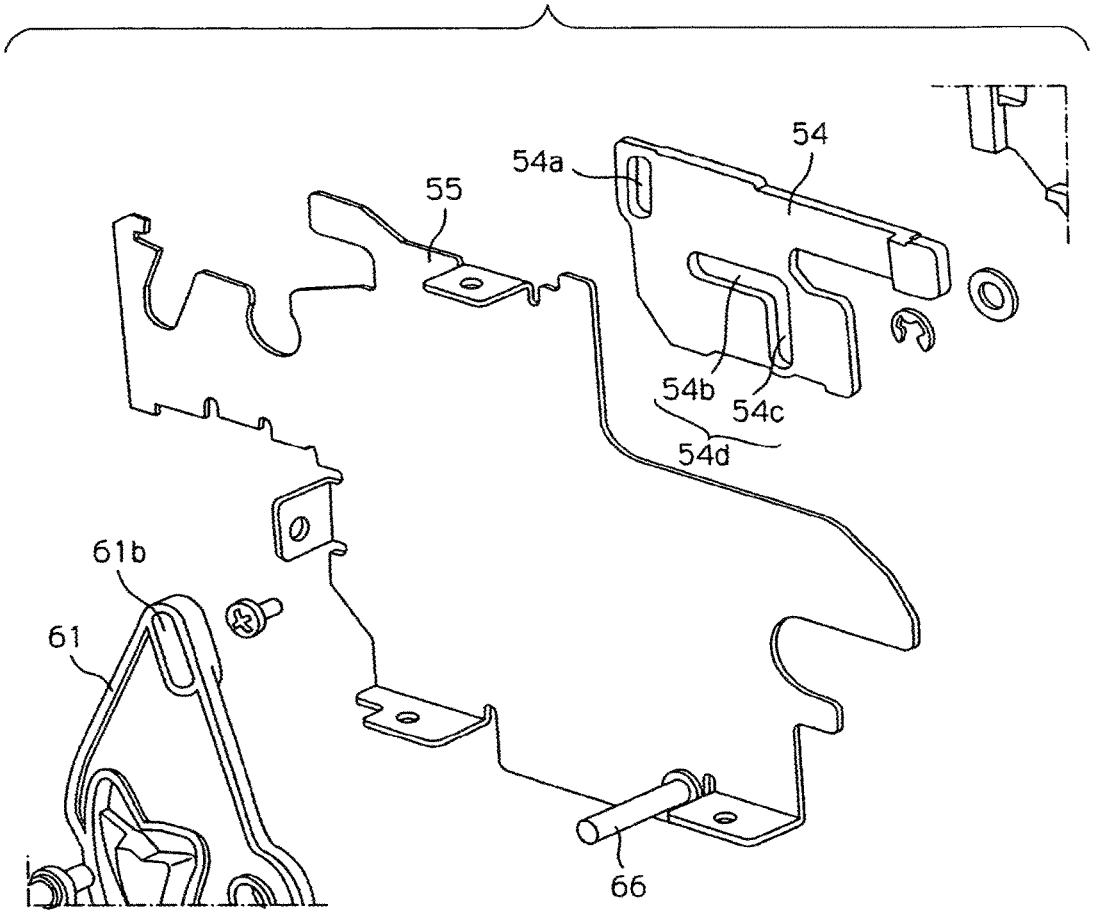

Next, referring to FIG. 9, as described above, the guide member 52 is fitted to the frame 55, which is provided upright in parallel with the guide member 52 and the link member 54. Further, in the frame 55, a shaft 66 is provided to project outward from the frame 55, and the heart cam 61 to be described below is rotatably supported by the shaft 66. In addition, the frame guide 56 is fitted to the frame 55 at a position opposite to the side end of the roller supporting frame 36, as shown in FIG. 8. In the frame guide 56, a guide groove 56*a* is formed, and, in the assembled state of the tray guide retainer 50, the projection 36*a* formed at the side end of the roller supporting frame 36 is idly inserted into the guide groove 56*a*. Accordingly, the roller supporting frame 36 are guided to the guide groove 56*a* and the second guide groove 52*b*, which is formed in the guide member 52, such that the sliding path of the roller supporting frame 36 is defined.

Figure 4:
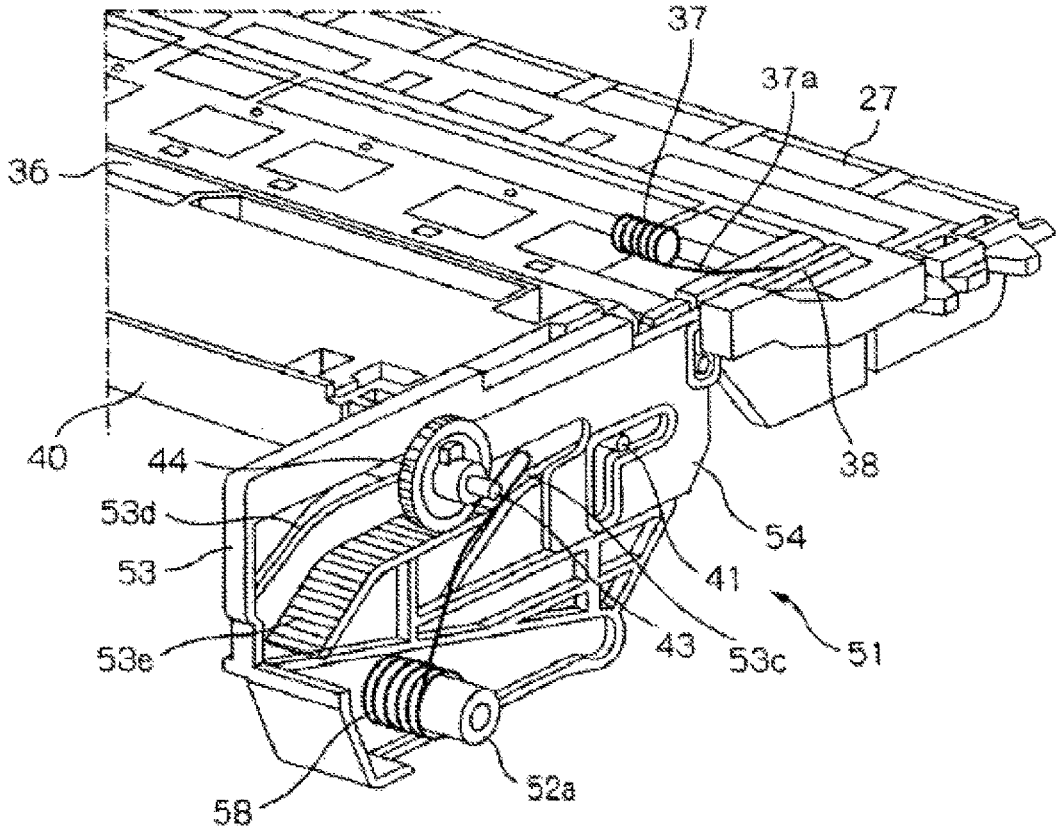
FIG. 4 is an enlarged perspective view of a right side of the front section.

Moreover, in the roller supporting frame 36, the torsional coiled springs 37 are provided in order to prevent elevation of the first follower roller 24 and the second follower roller 26 from the first driving roller 23 and the second driving roller 25, respectively (see FIGS. 4 and 5). With the torsional coiled springs 37, the first follower roller 24 and the second follower roller 26 are urged to be brought into contact with the first driving roller 23 and the second driving roller 25, respectively. Here, the torsional coiled springs 37 are arranged at both ends of the roller supporting frame 36 in its longitudinal direction and are fitted to a main frame 10 (see FIG. 1) to be fixed. On the other hand, since the roller supporting frame 36 slides in the medium transporting direction, one ends 37*a* of the torsional coiled springs 37 for urging the roller supporting frame 36 are configured to slide on guide rails 38 fitted to the roller supporting frame 36 according to the sliding operation of the roller supporting frame 36. Accordingly, it is configured such that urging force by the torsional coiled springs 37 does not interrupt the sliding operation of the roller supporting frame 36.

Subsequently, referring to FIG. 8, the heart cam 61 has a slot 61*b*, into which the end of the shaft 43 is idly inserted, a shaft hole 61*c*, into which the shaft 52*a* formed in the guide member 52 is fitted, and a cam groove 61*a*, which substantially has a heart shape in plan view and which is formed to have a vertical interval. The heart cam 61 is rotatably fitted to the shaft 52*a* of the guide member 52. In the heart cam 61, the end of the shaft 43 provided in the tray guide 40 is idly inserted into the shaft hole 61*b*, and thus the heart cam 61 is rotated around the shaft 52*a* according to the sliding operation of the tray guide 40.

Then, at a position opposite to the heart cam 61, a rod 62 having a shaft hole 62*c*, into which the shaft 66 provided in the frame 55 is fitted, is provided. The rod 62 is provided to be pivotable about the shaft 66, and has a positioning pin 62*a*, which is urged in a direction to be pressed into contact with a bottom face of the cam groove 61*a*. Further, the rod 62 has a projection 62*b*, which projects in a direction opposite to the projecting direction of the positioning pin 62*a*. At a position opposite to the projection 62*b*, a rod guide 63 is provided. The rod guide 63 has a slot (not shown), which is formed to follow the trace of the projection 62*b* according to the pivot movement of the rod 62. The projection 62*b* is idly inserted into the groove via the spring 64 and the slider 65. Accordingly, the positioning pin 62*a* is urged toward the bottom face of the cam groove 61*a*, and then the positioning pin 62*a* is pressed into contact with the cam groove 61*a* and moves in the cam groove 61*a* according to the rotation operation of the heart cam 61.

Figure 7:
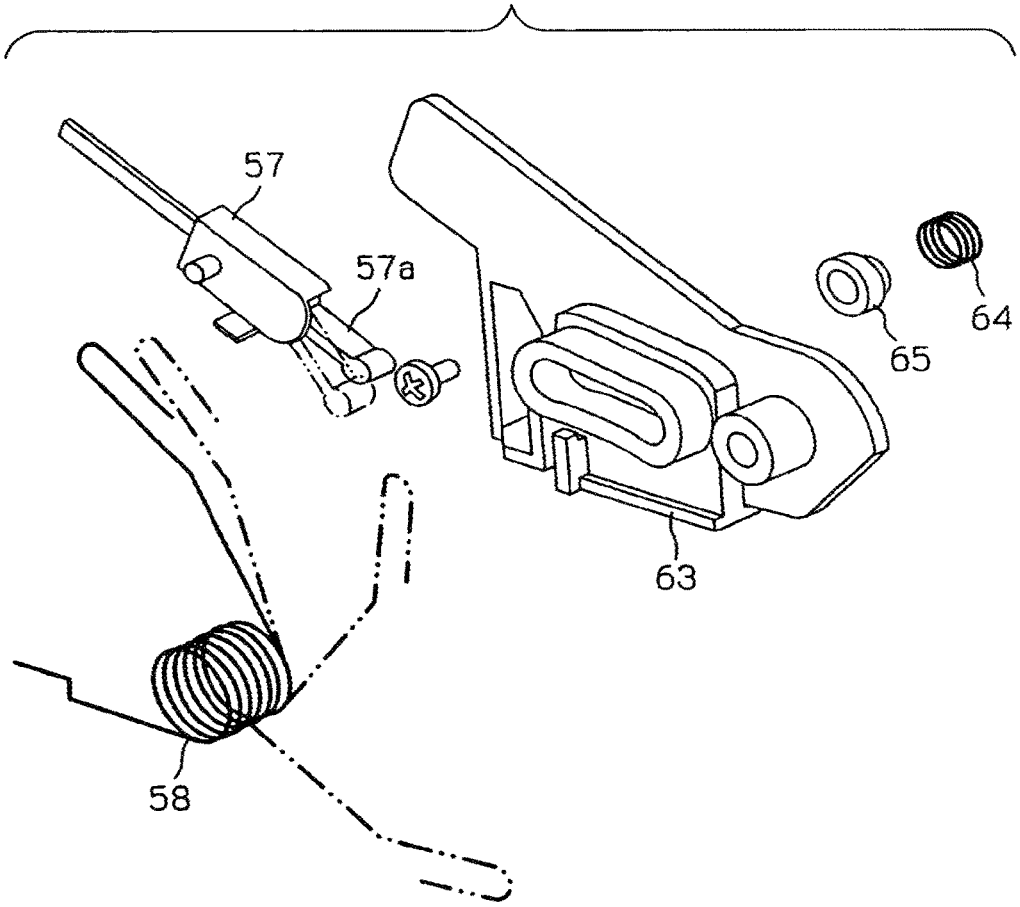
FIGS. 7 to 11 are enlarged perspective views showing respective parts shown in FIG. 6.

Moreover, as shown in FIG. 7, the position detector 57 is fitted to the rod guide 63. The position detector 57 has a pivotable lever 57*a* and, when the lever 57*a* is brought into contact with a detection face 61*d* formed on the circumference of the heart cam 61, is configured to detect the posture of the heart cam 61, that is, whether the tray guide 40 is at the first position or the second position.

The cam unit 60 having such a configuration is operable to hold the first guide pin 41, when the first guide pin 41 is idly inserted into the slot 61*a* formed in the heart cam 61, so as to hold the tray guide 40 at the second position, and to release the held state when the tray guide 40 held at the second position is pressed toward the rear side of the printer 1. Moreover, the detailed description of the operation of the cam unit 60 will be additionally given below.

In the shaft 52*a* formed in the guide member 52, a torsional coiled spring 58 is provided, and one end of the torsional coiled spring 58 is anchored by the first guide pin 41, and the other end thereof is anchored by a spring anchoring portion (not shown) formed in the frame 55. Accordingly, the first guide pin 41 is urged in a right direction of FIG. 13, that is, in a direction in which the tray guide 40 is displaced from the second position to the first position.

The above description relates to the configuration of the tray guide retainer 50, and, hereinafter, the operations of the respective parts of the tray guide retainer 50 described above will be described in detail with reference to FIGS. 16 to 20 and other drawings. For simplicity, the guide member 52 is not shown, and the first guide grooves 52*c* and 52*d* and the second guide groove 52*b* formed in the guide member 52 are shown in phantom lines.

Figure 16:
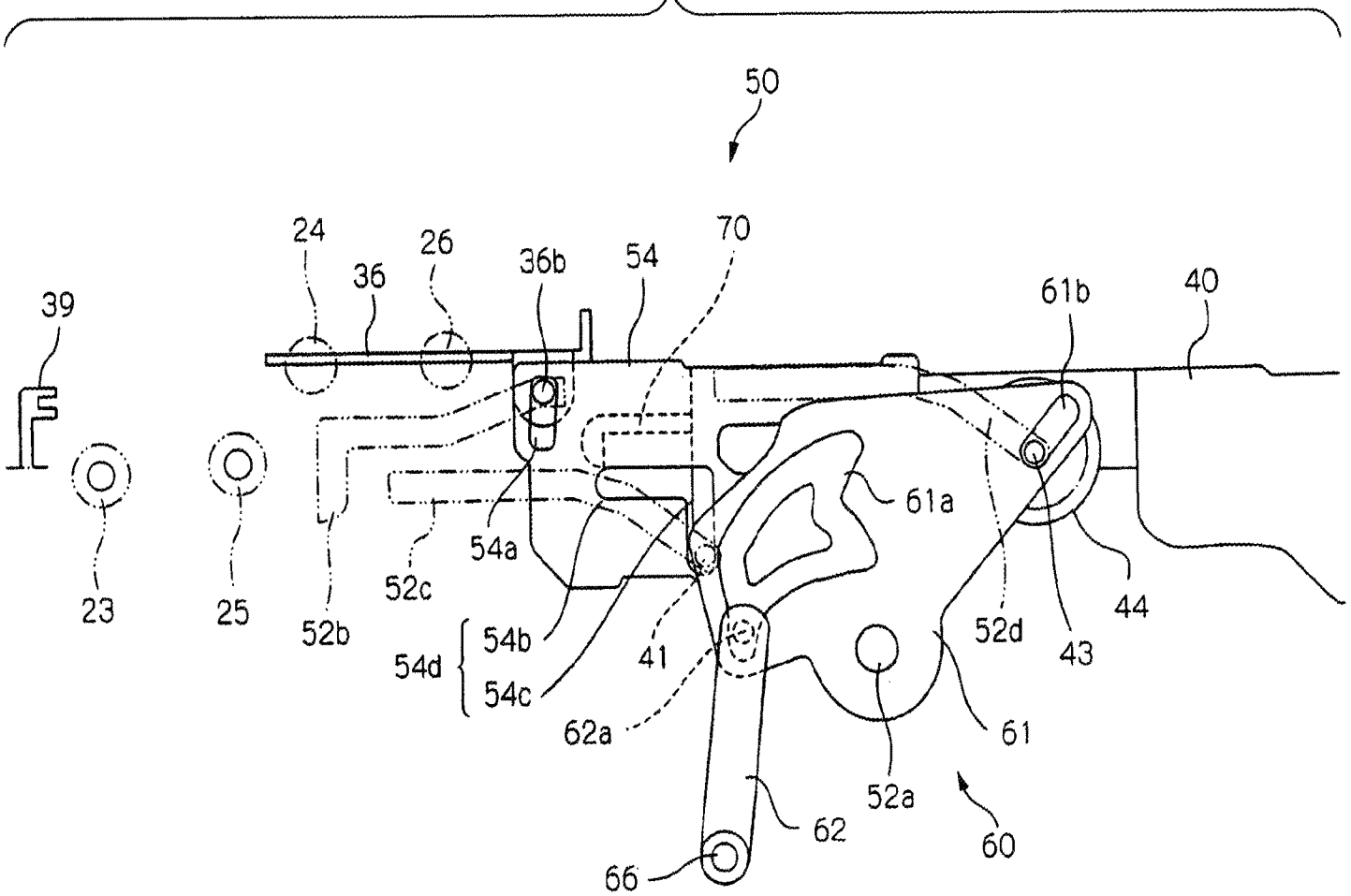
FIGS. 16 to 20 are views showing movements of the parts shown in FIG. 6 when the position of a tray guide in the printer is switched.

First, FIG. 16 shows a state in which the tray guide 40 is disposed at the first position (the position for guiding the tray T to the medium transporting path). In this state, by urging force of the torsional coil 58 acting on the first guide pin 41, the first guide pin 41 and the shaft 43 are held in a state of being disposed in the first guide grooves 52*c* and 52*d* on the front side of the printer 1 (the right end of FIG. 16), respectively. Here, as shown in FIG. 16, the first guide grooves 52*c* and 52*d* extend in the transporting direction of the tray T and are at high positions toward the rear side of the printer (the left side of FIG. 16). That is, the first guide grooves 52*c* and 52*d* have step shapes so as to move away from the medium transporting path. Accordingly, in a state in which the first guide pin 41 and the shaft 43 are disposed in the first guide grooves 52*c* and 52*d* in front of the printer (the right end of FIG. 16), the tray supporting face 40*a* of the tray guide 40 is disposed on an extension line of the medium transporting path, such that the tray T can be guided from the tray supporting face 40*a*.

Further, in this state, the positioning pin 62*a* in the cam unit 60 is disposed at a lower position in the step shape formed in the bottom face of the heart-shaped cam groove 61*a*. Then, the cam groove 61*a* will be described in detail with reference to FIG. 15.

Figure 15:
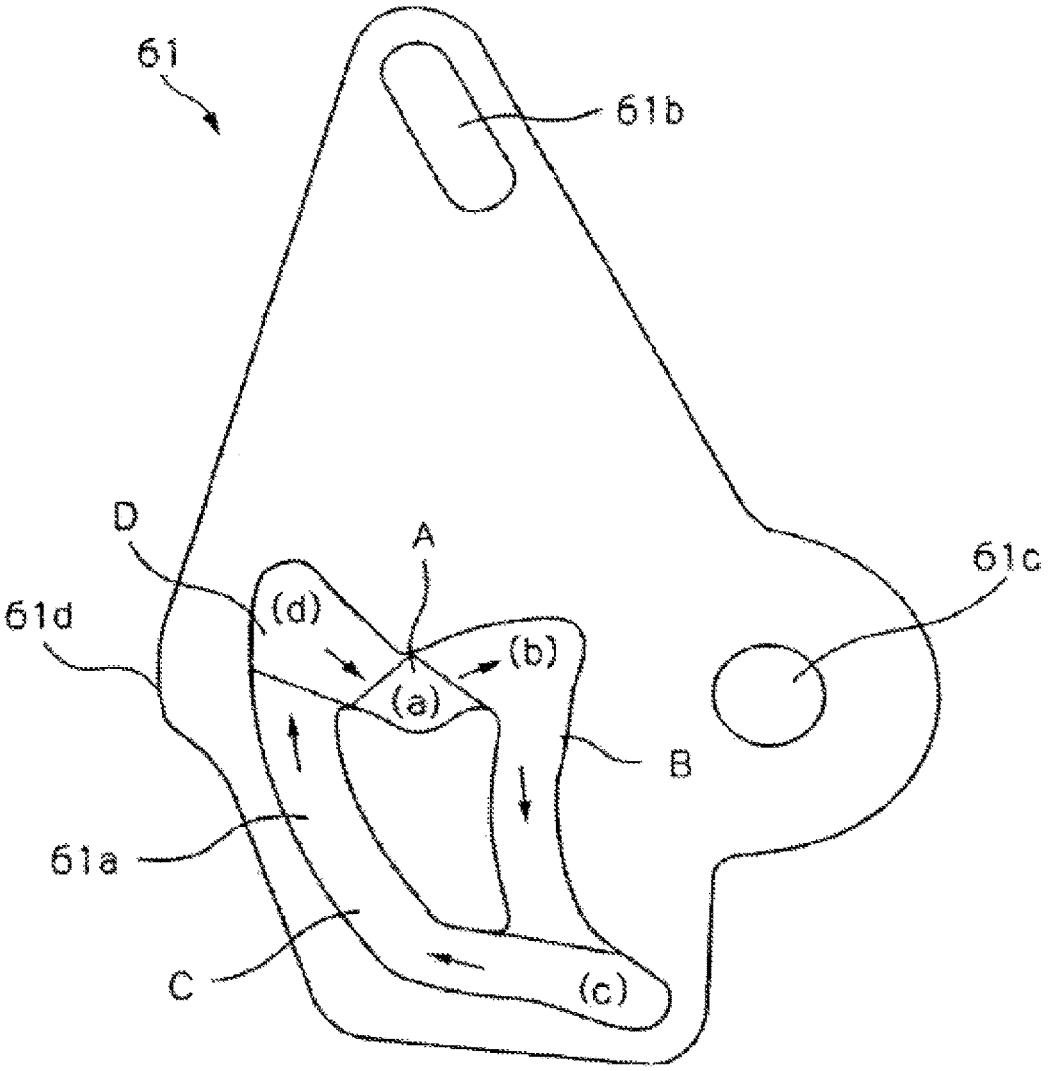
FIG. 15 is a plan view of a heart cam shown in FIG. 6.

The cam groove 61*a* has the bottom face in which plural steps (the vertical intervals: the direction perpendicular to the paper of FIG. 15) are formed. As shown in FIG. 15, four regions A, B, C, and D are divided. Specifically, at a boundary of two certain regions, a step is formed, and, in the vicinity of each boundary, when the positioning pin 62*a* moves in an individual arrow direction of FIG. 15, the vertical interval is set such that the positioning pin 62*a* moves from the higher position to the lower position (goes down the step). Further, the planar shape (the heart shape) and the step shape of the cam groove 61*a* are configured such that the positioning pin 62*a* does not move in directions opposite to the arrow directions of FIG. 15, that is, from the region A to the region D, from the region D to the region C, from the region C to the region B, and from the region B to the region A.

Hereinafter, as an example, a case in which the positioning pin 62*a* moves from a position (d) of the region D to a position (a) of the region A will be specifically described. Since the positioning pin 62*a* receives urging force of the spring 64 (FIG. 8) to be pressed into contact with the cam groove 61*a*, and thus the positioning pin 62*a* moves (is fitted) from the high position to the low position at the time of moving from the position (d) of the region D to the position (a) of the region A. Here, since the shaft 43, which is idly inserted into the slot 61*b*, that is, the tray guide 40, is urged to slide to the front side of the apparatus by the torsional coiled spring 58, the heart cam 61 is inclined so as to be constantly rotated in a clockwise direction of FIG. 15.

However, at the step between the region D and the region A, the position (a) is at the lower position, and the positioning pin 62*a*, which moves from the position (d) to the position (a), is pressed into contact with the stepped face between the region D and the region A by the rotation of the heart cam 61 in the clockwise direction of FIG. 15, and thus the positioning pin 62*a* is anchored by the step between the region D and the region A. That is, when the positioning pin 62*a* is anchored by the step between the region D and the region A, the heart cam 61 cannot be rotated in the clockwise direction of FIG. 15. Then, the heart cam 61 is positioned, and the tray guide 40 is held at the second position.

Hereinafter, similarly, the vertical intervals among the individual regions are set such that the positioning pin 62*a* moves only from the region A to the region B, from the region B to the region C, and from the region C to the region D. Moreover, in each of the regions B and C, the bottom face is formed with a smooth slope face such that the bottom face is made higher as goes toward in the arrow direction of FIG. 15. As such, the heart cam 61 (that is, the tray guide 40) tends to be positioned through the positioning pin 62*a*.

Hereinafter, as shown in FIG. 16, the operation of the tray guide 40 from the first position will be described in sequence. As shown in FIG. 16, when the tray guide 40 is at the first position, the positioning pin 62*a* is disposed at the position (c) in the region C of the cam groove 61*a*.

Further, at the first position, the first guide pin 41 and the shaft 43 provided in the tray guide 40 are disposed in the first guide grooves 52*c* and 52*d*, which are formed so as to go obliquely upward from the rear side (the right side of FIG. 16) of the apparatus to the front side (the left side of FIG. 16) of the apparatus on the forefront side of the apparatus. Accordingly, the tray guide 40 is held at the first position, and simultaneously the tray guide 40 is displaced in the downward direction. Then, the tray supporting face 40*a* extends to the medium transporting path, that is, the tray T can be guided from the tray supporting face 40*a* to the medium transporting path.

In addition, the second guide pin 36*b* provided in the roller supporting frame 36 is disposed in the second guide groove 52*b*, which is formed to go obliquely upward from the rear side of the apparatus to the front side of the apparatus, on the forefront side of the apparatus, and thus the roller supporting frame 36 is displaced upward, and the first follower roller 24 and the second follower roller 26 are disposed at the release positions to move away from the first driving roller 23 and the second driving roller 25.

Figure 17:
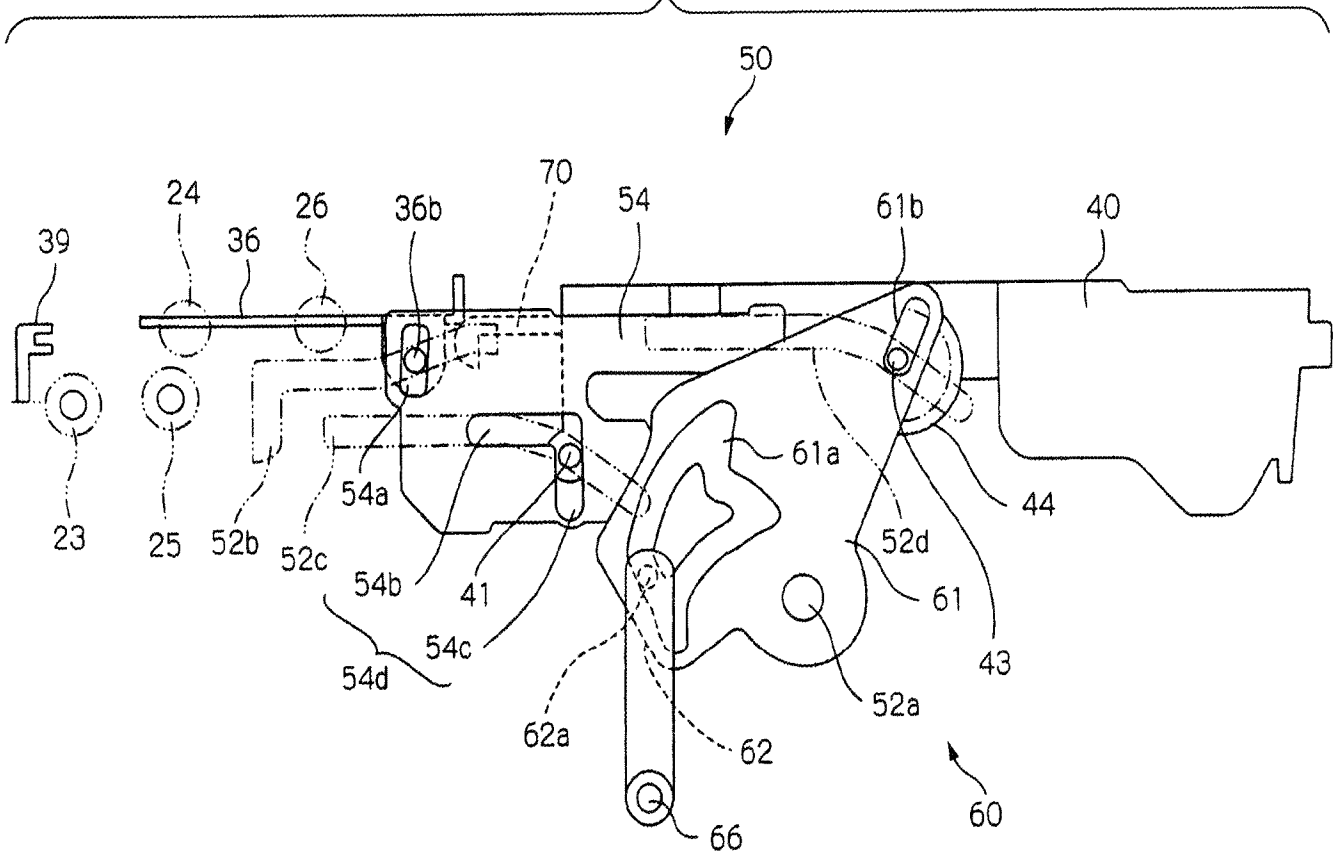

If the tray guide 40 is pressed toward the rear side of the apparatus in order to be displaced from the first position to the second position, as shown in the change from FIG. 16 to FIG. 17, the first guide pin 41 and the shaft 43 move in the first guide grooves 52*c* and 52*d*, respectively, and thus the tray guide 40 is displaced upward so as to move away from the medium transporting path.

Further, at this time, the first guide pin 41 is disposed in the vertically extending slot 54*c* of the third guide groove 54*d* formed in the link member 54, and thus the tray guide 40 and the roller supporting frame 36 substantially has the one-to-one relationship through the link member 54. Therefore, according to the displacement operation of the tray guide 40, the link member 54 and the second guide pin 36*b* (that is, the roller supporting frame 36) also moves toward the rear side of the apparatus.

Then, the second guide pin 36*b* moves in the second guide groove 52*b* toward the rear side of the apparatus, and thus the roller supporting frame 36 is displaced in the downward direction (in the direction to approach the medium transporting path). That is, the first follower roller 24 and the second follower roller 26 are displaced to the contact positions to be brought into contact with the first driving roller 23 and the second driving roller 25, respectively. In addition, at this time, in the cam unit 60, the positioning pin 62*a* is displaced in the arrow direction of FIG. 15 in the region C of the guide groove 61*a* according to the rotation of the heart cam 61.

Figure 18:
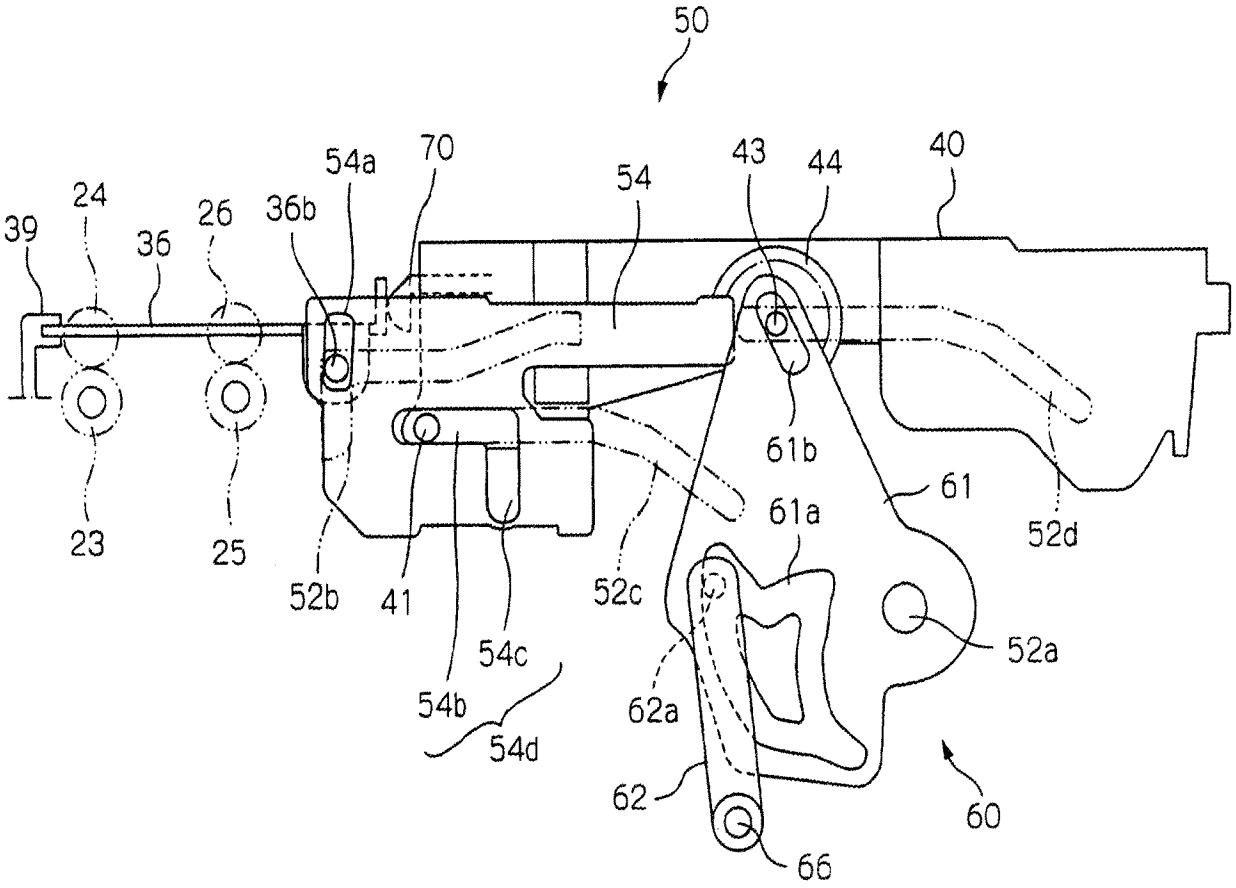

Next, in a process that the tray guide 40 is further pressed toward the rear side of the apparatus, as shown in the change from FIG. 17 to FIG. 18, the first guide pin 41 moves from the vertically extending slot 54*c* to the horizontally extending slot 54*b*. If doing so, at the time of the horizontal movement, the one-to-one relationship of the tray guide 40 and the roller supporting frame 36 is released, and the movement of the roller supporting frame 36 toward the rear side of the apparatus is regulated by the stopper 39, such that the position (the contact position) thereof is determined. Accordingly, after the first guide pin 41 moves from the vertically extending slot 54*c* to the horizontally extending slot 54*b*, only the tray guide 40 is displaced toward the rear side of the apparatus. Moreover, through described below in detail, in this state, the roller supporting frame 36 is urged toward the stopper 39 by the latch lever 70 provided in the tray guide 40, and is held at the contact position. Further, in the cam unit 60, when the tray guide 40 is pressed toward the rear side of the apparatus to the maximum, the positioning pin 62*a* moves from the region C to the region D in the cam groove 61*a*.

Figure 19:
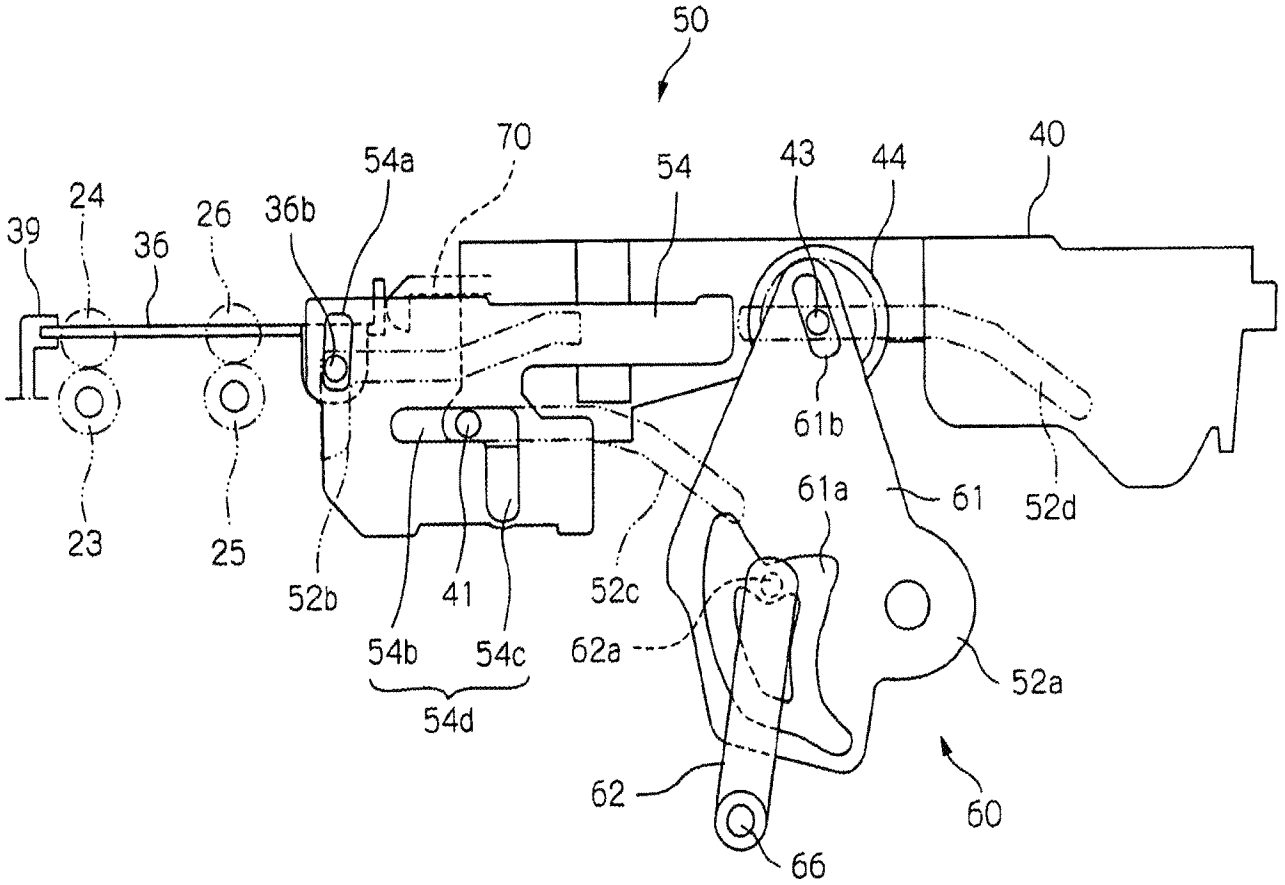
Figure 20:
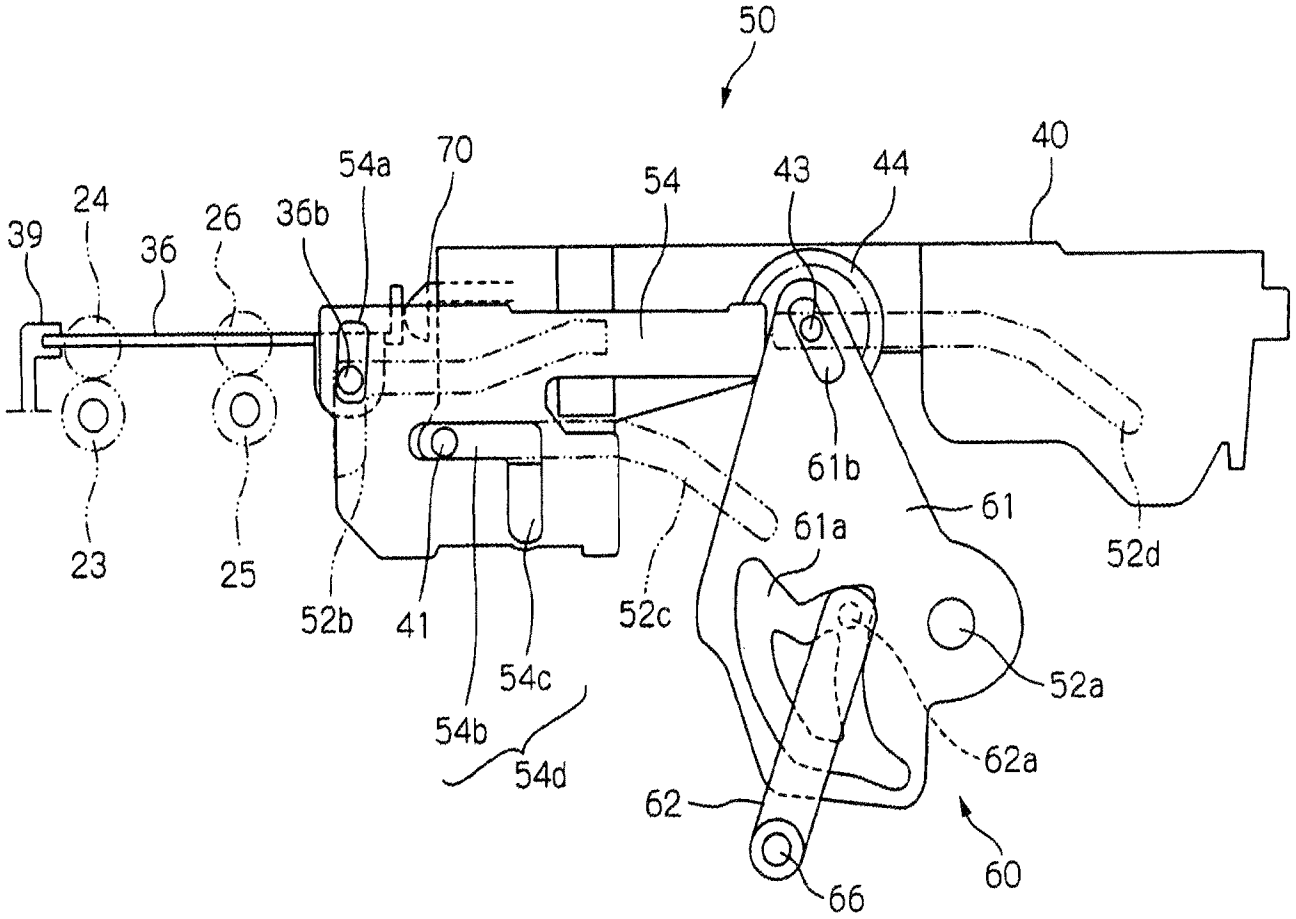

Then, the tray guide 40 is pressed toward the rear side of the apparatus to the maximum and, in this state, if the hand is escaped, the tray guide 40 returns to the front side of the apparatus by urging force of the torsional coiled spring 58. However, as described above, if the positioning pin 62*a* of the cam unit 60 moves from the position (d) to the position (a) of FIG. 15, the positioning pin 62*a* is anchored by the step between the region D and the region A. Therefore, as shown in FIG. 19, the heart cam 61 is positioned, that is, the tray guide 40 is held at the second position.

At the second position (FIG. 19), the first guide pin 41 and the shaft 43 provided in the tray guide 40 are disposed in the first guide grooves 52*c* and 52*d* on the rear side of the apparatus, and thus the tray guide 40 is moved away from the medium transporting path upward. Further, the second guide pin 36*b* provided in the roller supporting frame 36 is disposed in the second guide groove 52*b* on the rearmost side of the apparatus, and the first follower roller 24 and the second follower roller 26 are disposed at the contact positions to be brought into contact with the first driving roller 23 and the second driving roller 25, respectively.

In order to release the held state of the tray guide 40 at the second position, the tray guide 40 is further pressed toward the rear side of the apparatus. By doing so, as shown in the change from FIG. 19 to FIG. 20, the positioning pin 62*a* moves from the position (a) to the position (b) of FIG. 15 in the cam groove 61*a*. If the positioning pin 62*a* moves to the position (b), the positioning pin 62*a* can move to the next position (c) (a position of the positioning pin 62*a* at the first position), and thus, as described above, if the tray guide 40 at the second position is pressed toward the rear side of the apparatus, the tray guide retainer 50 releases the held state of the tray guide 40. After the held state at the second position is released, if the hand is separated from the tray guide 40, the tray guide 40 moves toward the front side of the apparatus by urging force of the torsional coiled spring 58 and is at the first position again, as shown in FIG. 16. Further, at this time, the roller supporting frame 36 moves toward the front side of the apparatus again to be at the release position.

As described above, the tray guide 40 that has the tray supporting face 40*a* for supporting the tray T, and is displaced between the first position at which the tray T is guided from the tray supporting face 40*a* to the medium transporting path and the second position at which the tray T is escaped from the medium transporting path is displaced between the first position and the second position when the transporting path of the tray T is laterally viewed, while the tray supporting face 40*a* maintains the posture along the transporting direction of the tray T (the horizontal posture in the present embodiment), as shown in FIGS. 16 to 20. That is, the tray guide 40 slides in the depthwise direction of the printer 1 to be displaced between the first position and the second position. Therefore, the displacement movement of the tray guide 40 can be simplified, and thus operability of the tray guide 40 can be enhanced. Further, as for the operation of the tray guide 40, a space in the heightwise direction of the apparatus does not need to be provided, and thus the size of the apparatus in the heightwise direction can be further reduced.

Further, at the second position, the tray guide 40 is escaped from the medium transporting path upward, and thus, at the time of ejecting the paper P, the path for ejecting the paper P can be prevented from being complicated, without being interrupted by the tray guide 40.

In addition, the tray guide retainer 50 presses the tray guide 40 toward the rear side of the apparatus so as to hold the tray guide at the second position, and further presses the tray guide 40 at the second position toward the rear side of the apparatus so as to release the held state at the second position. That is, with the so-called push-on operation, position switching is performed, and thus the position switching operation is simple, which makes it easy for the user to understand the position switching operation. Therefore, a user-friendly apparatus can be obtained. In addition, at the time of the switching operation from the second position to the first position, only if the tray guide 40 is pressed toward the rear side of the apparatus, and then the hand is separated, switching to the second position is performed by urging force of the torsional coiled spring 58, such that the operation can be easily performed with a small load.

Further, according to the configuration of the tray guide retainer 50, the first guide pin 41 provided in the tray guide 40 and the second guide pin 36*b* provided in the roller supporting frame 36 are connected to each other through the link members 54, and thus the connection between them can be performed while ensuring the degree of freedom of the operation. In addition, since the first guide pin 41 is idly inserted into the third guide groove 54*d*, which has the vertically extending slot 54*c* and the horizontally extending slot 54*b*, a latch stroke can be ensured by the horizontally extending slot 54*b*. Here, the "latch stroke" is a stroke of the tray guide 40 which is needed to trap the positioning pin 62*a* at the position (a) (FIG. 15) in the cam groove 61*a* of the heart cam 61 (holds at the second position of the tray guide 40) and a stroke of the tray guide 40 which is needed to move the positioning pin 62*a* held at the position (a) to the position (b) (releases the held state at the second position of the tray guide 40), while the roller supporting frame 36 is held at the contact position.

Moreover, in the present embodiment, the tray supporting face 40*a* is horizontal at the first position and the second position, and the tray guide 40 is displaced between the first position and the second position while the tray supporting face 40*a* maintains the horizontal state. The term "horizontal state" of the tray supporting face 40*a* does not necessarily mean the complete horizontal state, in terms of saving the space of the apparatus in the heightwise direction. That is, the posture may be close to the complete horizontal state, and its range can be suitably designed by an ordinary skilled person according to the configuration of the apparatus or the like.

Subsequently, other parts of the tray guide 40 and the tray guide retainer 50 will be described.

As described above with reference to FIGS. 4 and 5, when the first guide pin 41 and the shaft 43 are guided in the first guide grooves 52*c* and 52*d* (and the first guide grooves 53*c* and 53*d*) formed in the guide member 52 (and the guide member 53), the tray guide 40 slides in the depthwise direction of the apparatus while the tray supporting face 40*a* maintains the horizontal posture. In this case, if the left and right sides do not slide in alignment, the tray guide 40 obliquely moves at the time of the sliding operation, and thus a smooth sliding operation may not be performed. Further, it may be difficult to perform the sliding operation.

Accordingly, the racks 52*e* and 53*e* are formed in the guide members 52 and 53 on the left and right sides, and the pinion gears 44 are fitted to both ends of the shaft 43, which is rotatably supported by the tray guide 40, so as to be interlocked with the racks 52*e* and 53*e*, respectively. Therefore, at the time of the sliding operation of the tray guide 40, the left and right sides are in alignment, and the oblique movement is prevented, such that a smooth sliding operation can be performed.

Figure 24:
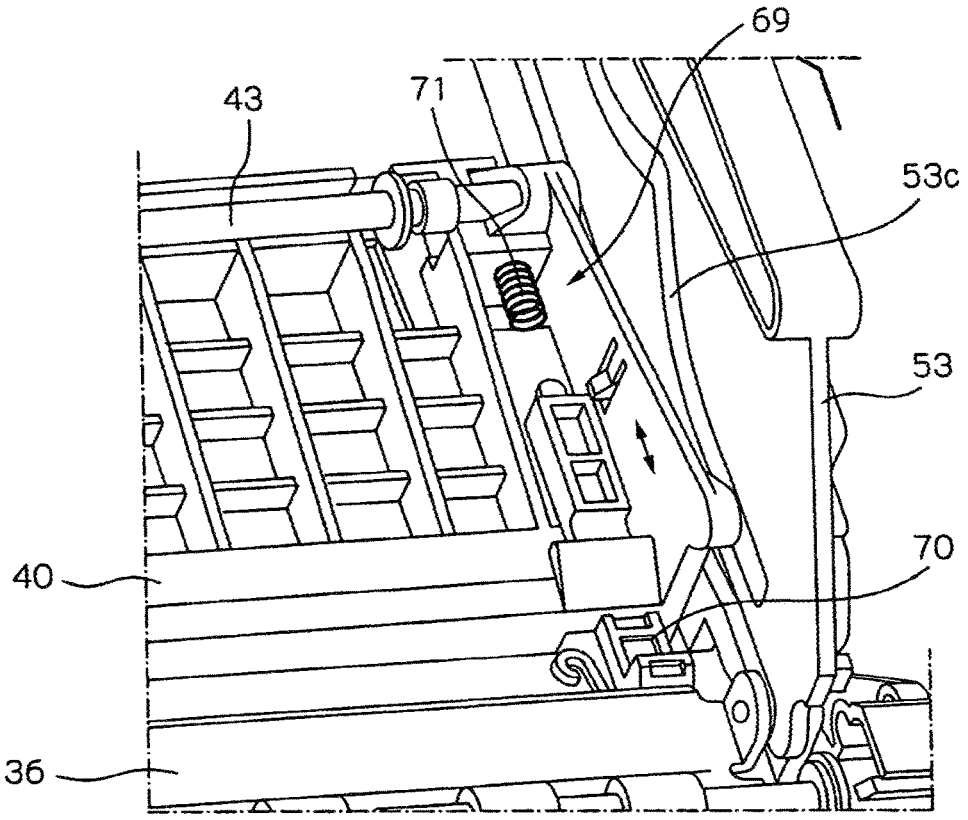
FIG. 24 is an enlarged perspective view of an urging member and a latchet lever in the tray guide.
Figure 29:
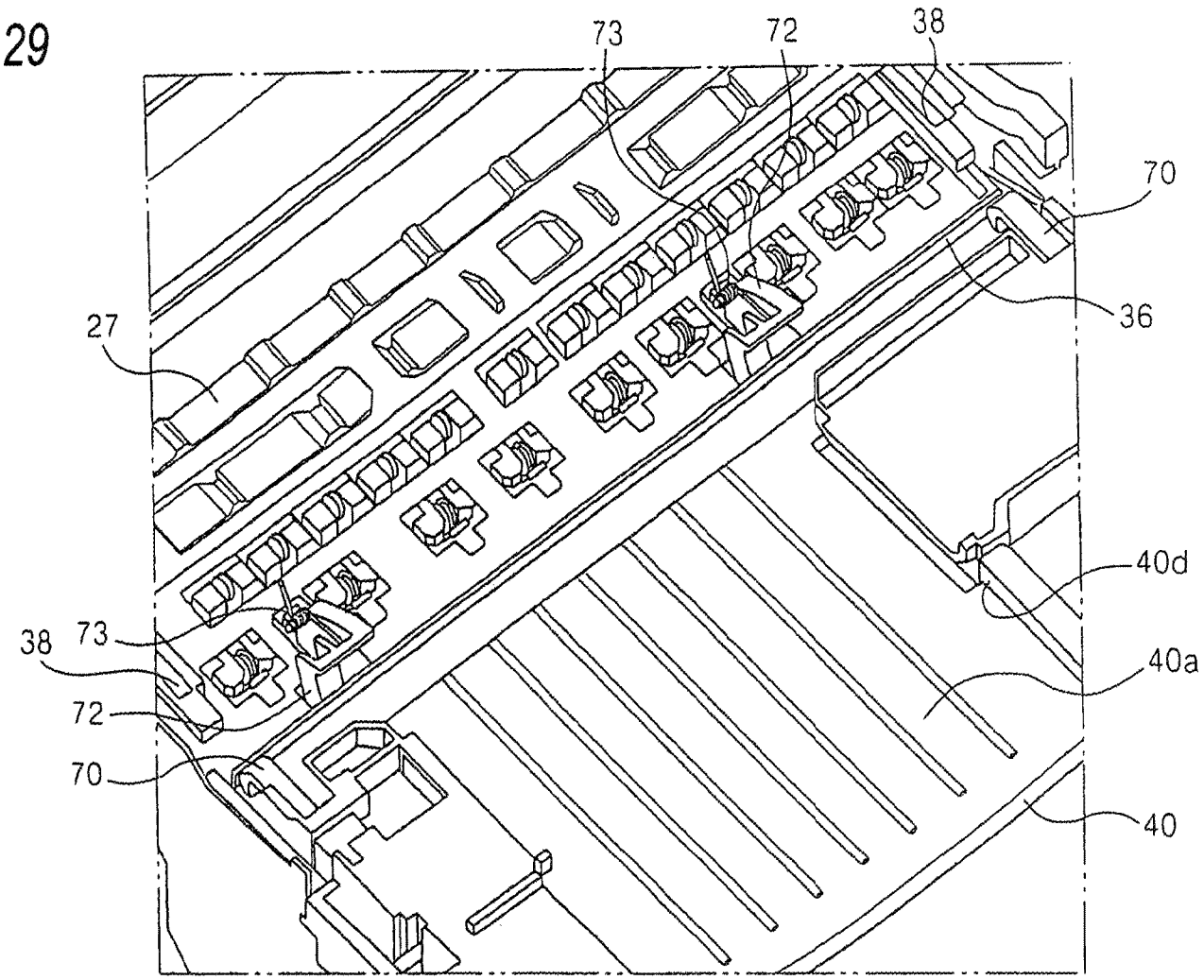
FIG. 29 is a perspective view showing a height regulator for the tray guide.

Further, at the time of the sliding operation of the roller supporting frame 36, similarly, a problem of the oblique movement also occurs. Therefore, in the present embodiment, as shown in FIGS. 24 and 29, urging members 69 are provided in the tray guide 40 so as to urge both side ends of the roller supporting frame 36 toward the contact position of the roller supporting frame 36. As a result, the oblique movement caused by the sliding operation of the roller supporting frame 36 is prevented.

Hereinafter, the detailed descriptions will be given. As shown in FIG. 24, on the surface opposite to the tray supporting face 40*a* of the tray guide 40, the urging members, each having the latch lever 70 and a compression spring 71, are provided at positions corresponding to both longitudinal ends of the roller supporting frame 36 so as to urge both longitudinal ends of the roller supporting frame 36. The latch lever 70 is provided to slide along the sliding direction (arrow direction) of the tray guide 40 and the roller supporting frame 36 and to project toward the roller supporting frame 36. Further, the compression spring 71 is provided to engage with the latch lever 70 so as to urge the latch lever 70 toward the roller supporting frame 36.

As shown in FIG. 16, when the tray guide 40 is at the first position, and the roller supporting frame 36 is at the release position, the latch lever 70 is disposed obliquely away from the roller supporting frame 36 in the downward direction so as not to engage with the roller supporting frame 36. However, as shown in the changes over FIGS. 16 to 18, when the tray guide 40 at the first position is pressed toward the rear side of the apparatus, the latch lever 70 engages with in a process of switching to the second position, and then urges the downstream-side end of the roller supporting frame 36 to the contact position with the operation of the compression spring 71.

Specifically, as shown in the changes over FIGS. 16 to 18, when the tray guide 40 at the first position is pressed toward the rear side of the apparatus, the first guide pin 41 is disposed in the vertically extending slot 54*c* in a process of switching to the second position, as described above. Accordingly, the tray guide 40 and the roller supporting frame 36 are connected to each other in the one-to-one manner, and thus the roller supporting frame 36 slides. Then, if the first guide pin 41 moves to the horizontally extending slot 54*b*, the latch lever 70 presses the roller supporting frame 36 toward the contact position, and then the roller supporting frame 36 moves to the second position.

Here, as shown in FIG. 29, the latch levers 70 urge both longitudinal ends of the roller supporting frame 36, that is, urge the roller supporting frame 36 at symmetrical positions with respect to the longitudinal center of the roller supporting frame 36. Accordingly, even when the roller supporting frame 36 obliquely moves at the time of the sliding operation, the roller supporting frame 36 returns to the original posture by urging force received from the latch levers 70. Therefore, the roller supporting frame 36 can smoothly perform the sliding operation, without the oblique movement, while maintaining the stable posture. In particular, in the present embodiment, since both longitudinal ends of the roller supporting frame 36 are urged, the sliding operation can be performed more stably.

Further, in such a manner, the roller supporting frame 36 is pressed while being balanced by urging force, and thus, even when the tray guide 40 provided with the latch lever 70 obliquely moves to some extent, the sliding operation can be smoothly performed, without being influenced by the oblique movement. That is, even when the tray guide 40 and the roller supporting frame 36 are connected to each other via the link members 54 on the left and right sides in the one-to-one manner, there may be a case in which the roller supporting frame 36 does not receive uniform force from the left and right sides. In this case, however, the posture of the roller supporting frame 36 is balanced by urging force received from the latch levers 70, such that the sliding operation can be smoothly performed, without the oblique movement.

Figure 21:
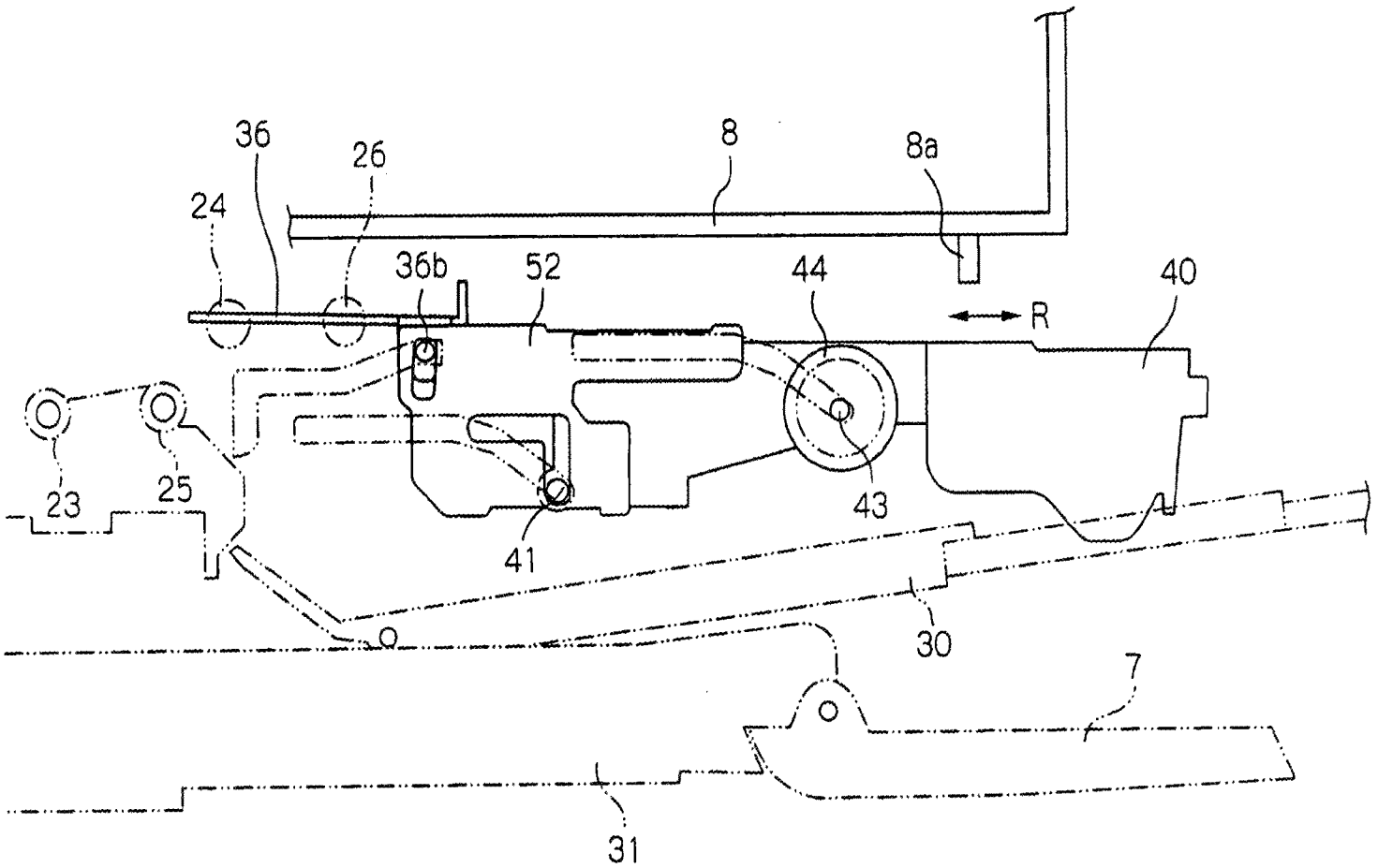
FIGS. 21 and 22 are views showing the positions of the tray guide relative to the upper housing.
Figure 22:
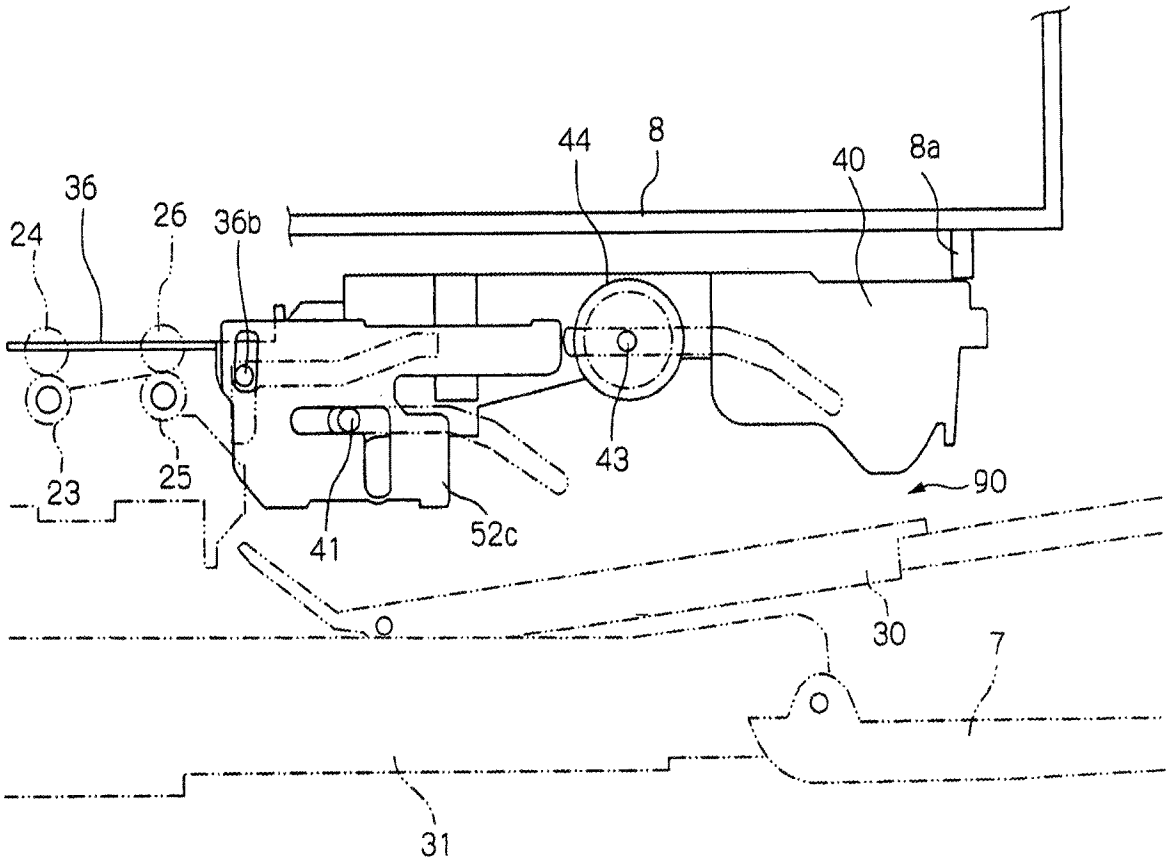

FIGS. 21 and 22 are side views of the tray guide retainer 50 shown in FIGS. 16 to 20. Specifically, these figures show the relationship among other parts of the printer 1, in particular, the relationship between an upper housing 8 and the stacker 30. The upper housing 8 constitutes the appearance of the printer 1. When the tray guide 40 is at the first position, the upper housing 8 constitute an opening, into with the tray T is inserted, together with the tray supporting face 40*a*. Here, in a portion of the upper housing 8 facing the tray guide 40, a stopper 8*a* is formed to droop toward the tray guide 40*a*. The stopper 8*a* opens the transporting path R for transporting the tray T when the tray guide 40 is at the first position (FIG. 21), but blocks the transporting path R, that is, shuts off the opening for inserting the tray T, when the tray guide 40 is at the second position (FIG. 22). Accordingly, there is no case in which the tray T is erroneously sent in the apparatus when the tray guide 40 is at the second position, the tray T or the parts in the apparatus can be prevented from being damaged.

Figure 23:
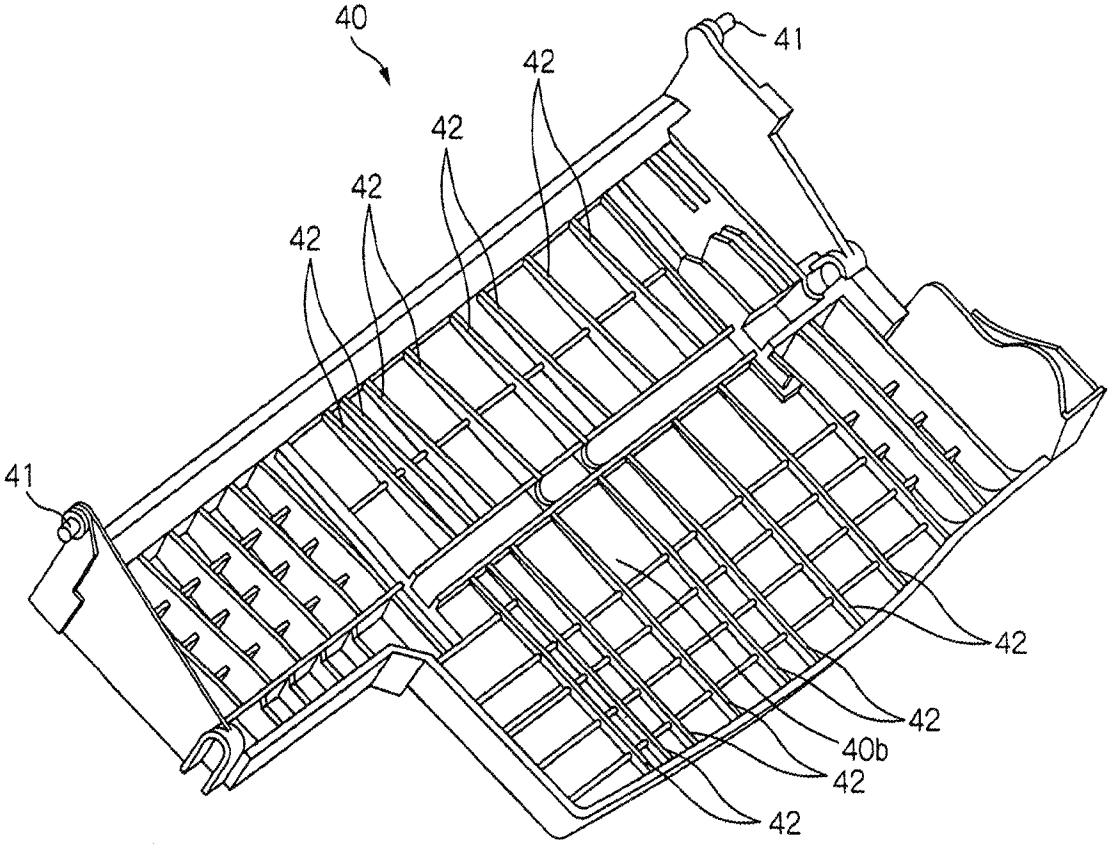
FIG. 23 is a perspective view of a back side of the tray guide.

Moreover, as shown in FIG. 22, in a state in which the tray guide 40 is at the second position, a region 90 facing the surface (which is denoted by reference numeral 40*b* in FIG. 23) opposite to the tray supporting face 40*a* is a discharge region of the paper P onto which recording was performed. On the surface 40*b* opposite to the tray supporting face 40*a*, as shown in FIG. 23, a rib 42, which extends in the ejecting direction of the paper P, is formed by a suitable gap in a direction perpendicular to the ejecting direction of the paper P (the widthwise direction of the paper P). The rib 42 is formed at a position corresponding to the side end of the paper P in relation to the size of the paper P in the widthwise direction, and then, when the paper P is ejected, the side end of the paper P can be smoothly ejected, not caught by the tray guide 40.

Next, a locker 75 for locking the tray guide 40 at the second position will be described with reference to FIGS. 25 to 28.

Figure 25:
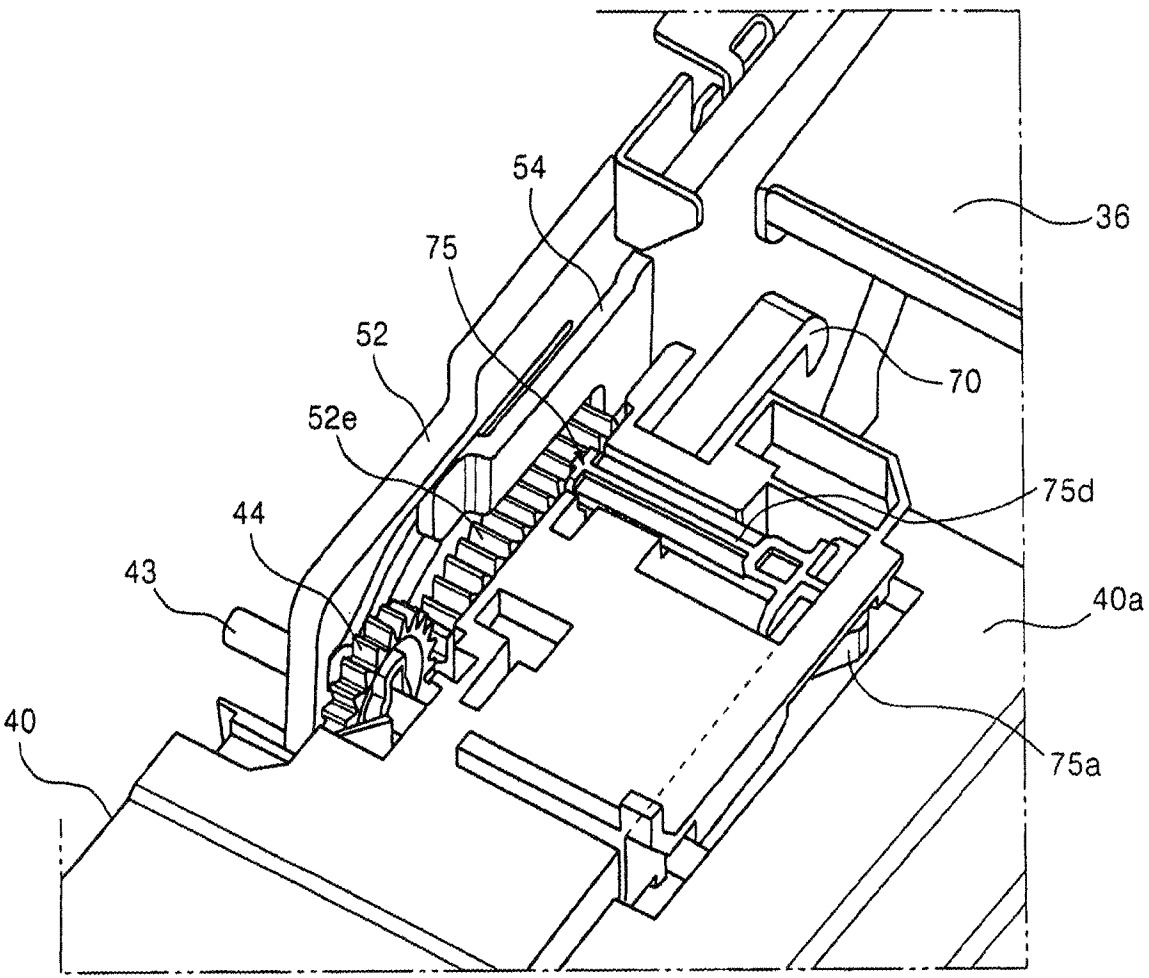
FIG. 25 is a perspective view showing a locker for the tray guide.

As shown in FIG. 25, on the side of the tray supporting face 40*a* of the tray guide 40, the locker 75 is provided so as to slide in a direction perpendicular to the sliding direction of the tray guide 40 (the widthwise direction of the tray T).

Figure 28A:
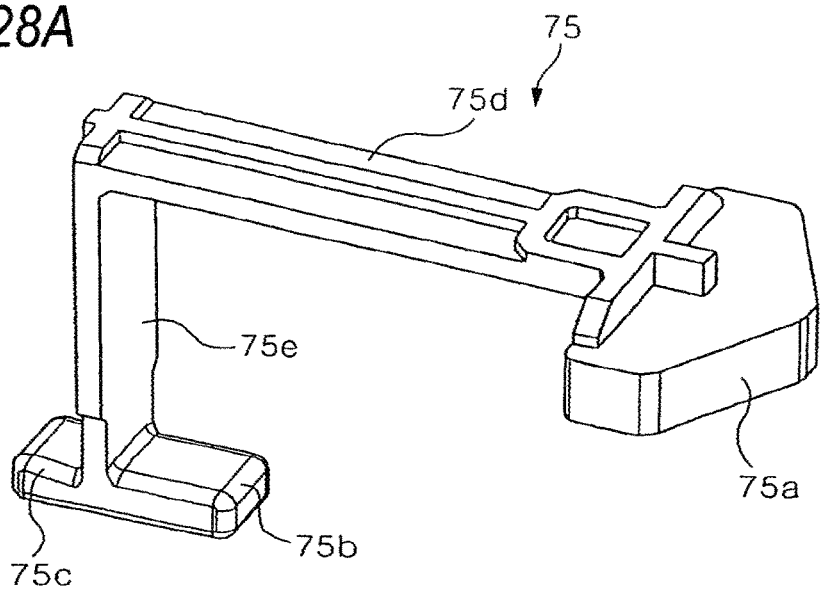
FIGS. 28A and 28B are enlarged perspective views of the locker.
Figure 28B:
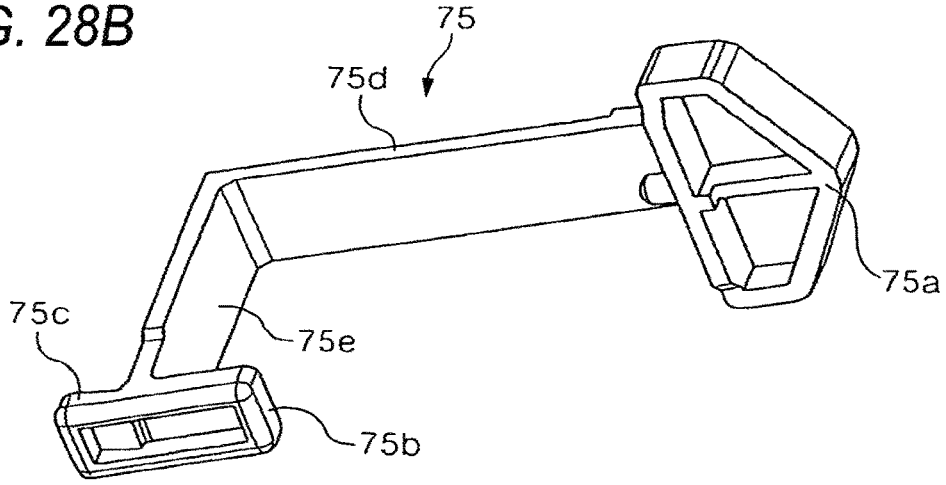

Specifically, as shown in FIG. 28 in detail, the locker 75 is provided in the tray guide 40 to substantially have an L shape, which is formed by an arm portion 75*d* extending in the direction perpendicular to the sliding direction of the tray guide 40 and an arm portion 75*e* extending in a direction perpendicular to the tray supporting face 40*a*. Further, at the front end of the arm portion 75*d*, a tray engagement portion 75*a* is formed to engage with the side end of the tray T. In addition, at a lower end of the arm portion 75*e*, a frame engagement portion 75*c* is formed to project toward the guide member 52, which is provided to face the side end of the tray guide 40. Further, a guide engagement portion 75*b* is formed to project in a direction opposite to the projecting direction of the frame engagement portion 75*c*, that is, in a direction toward the tray guide 40.

Figure 26:
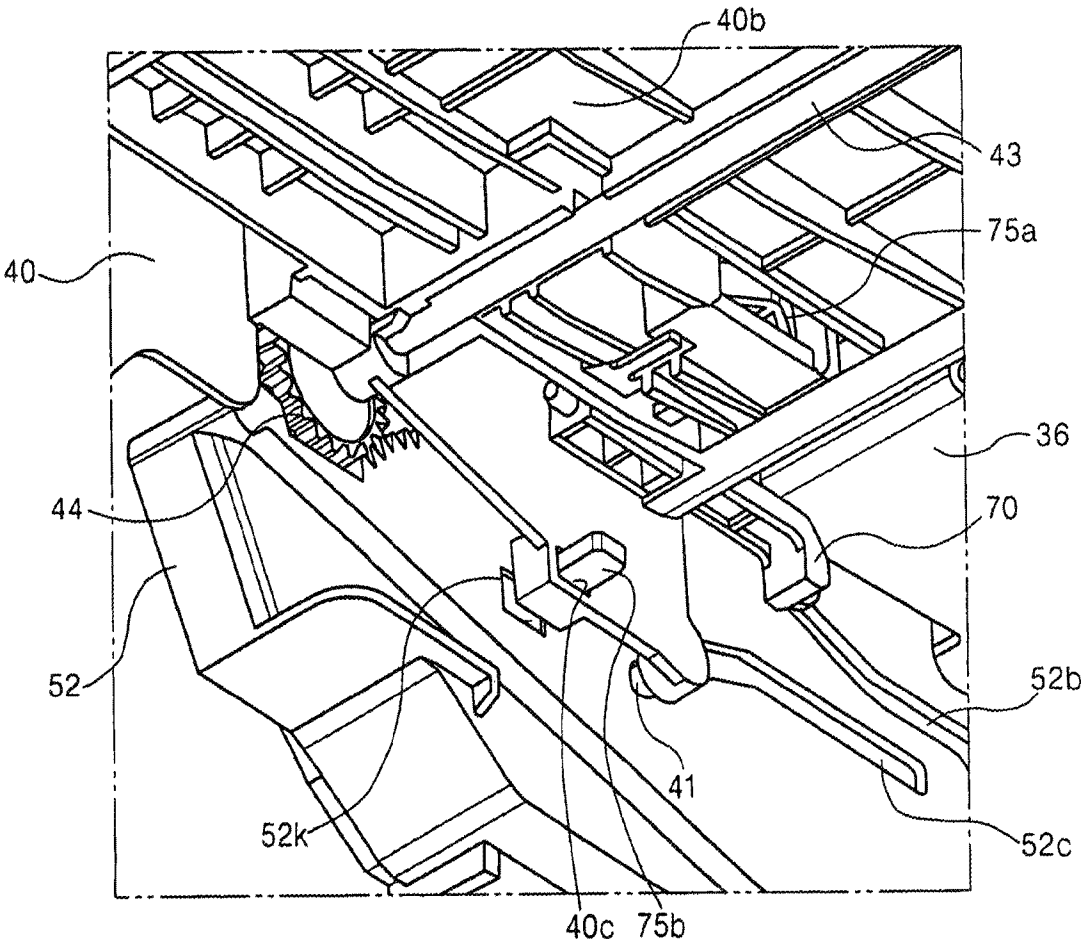
FIGS. 26 and 27 are enlarged perspective views for explaining a locking operation of the locker.
Figure 27:
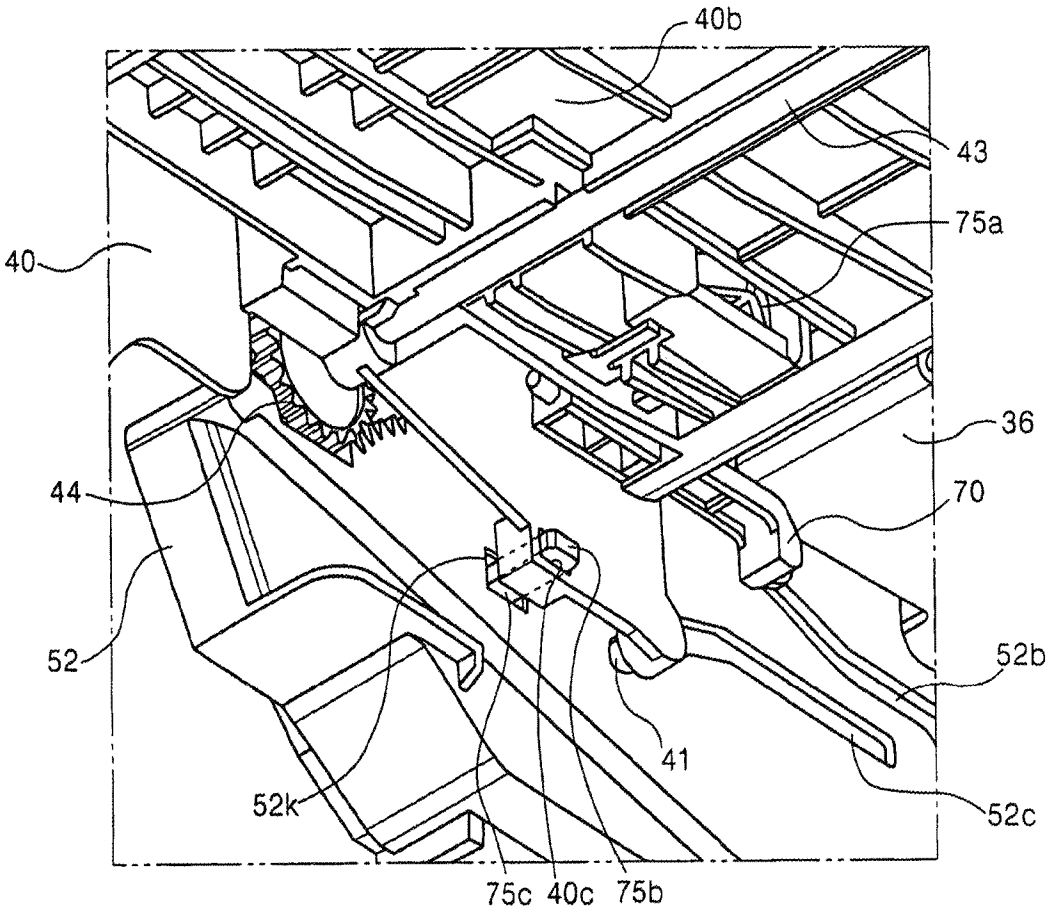

On the other hand, in the guide member 52, a first hole 52*k* (see FIGS. 25 and 26) are formed, and, on the tray guide 40, a second hole 40*c*, which can face the first hole 52*k* is formed, as shown in FIGS. 26 and 27. In a state in which the locker 75 is provided in the tray guide 40, the guide engagement portion 75*b* is fitted into the second hole 40*c*, and simultaneously, in a state in which the first hole 52*k* and the second hole 40*c* face each other, the frame engagement portion 75*c* can be fitted into the first hole 52*k*. Moreover, the first hole 52*k* and the second hole 40*c* are formed to face each other when the tray guide 40 is at the first position.

Hereinafter, the operation of the locker 75 will be described. In a state in which the tray T is not set on the tray guide 40, the tray engagement 75*a* of the locker 75 is urged by an urging member (not shown) so as to project with respect to the transporting path (the tray supporting face 40*a*) of the tray T, as shown in FIG. 25.

In this state, as shown in FIG. 26, the frame engagement portion 75*c* is moved away from the guide member 52, and thus the tray guide 40 can slide with respect to the guide member 52.

In this state, if the tray T is set on the tray guide 40, the tray T engages with the tray engagement portion 75*a*, and then the locker 75 slides in a direction distant from the side end of the tray T. By doing so, as shown in FIG. 26, the frame engagement portion 75*c* is fitted into the first hole 52*k* and the guide engagement portion 75*b* is fitted into the second hole 40*c*. That is, the locker 75 passes through the first hole 52*k* and the second hole 40*c* to extend over the first hole 52*k* and the second hole 40*c* facing each other, such that the tray guide 40 cannot slide with respect to the guide member 52. That is, since the tray guide 40 is locked at the first position, even when the position switching operation of the tray guide 40 is executed in a state in which the tray T is supported on the tray guide 40, the position of the tray guide 40 does not change, and thus an inconsistency that compulsive force is applied to the tray T to be destroyed or the disc OD set on the tray T is damaged can be prevented from occurring.

In particular, in the present embodiment, as the tray T is set on the tray guide 40 at the first position, the tray guide 40 is, so to speak, automatically locked. Therefore, the tray guide 40 can be retained at the first position with no additional special operation, and thus a user-friendly apparatus can be obtained. Further, the operation can be prevented from being forgotten, and thus the tray T or the disc OD can be reliably protected.

Further, the locker 75 passes through the first hole 52*k* and the second hole 40*c* so as to extend over the first hole 52*k* and the second hole 40*c* facing each other, and then the tray guide 40 is retained at the first position. Therefore, the tray guide 40 and the guide member 52 can engage with each other at a position close to each other, and thus the tray guide 40 can be tightly, not unsteadily, retained at the first position.

In addition, in the present embodiment, the locker 75 is configured to press one side end of the tray T toward the other end. Therefore, when the tray T is set on the tray guide 40, the tray T is pressed toward an edge guide (which is denoted by reference numeral 40*d* in FIG. 29) of the other end side, and thus the oblique movement (skew) of the tray T can be prevented or reduced.

Moreover, in the present embodiment, the locker 75 is configured to regulate the sliding operation of the tray guide 40, which slides along the transporting direction of the tray T. However, the present invention is not limited to the locker 75. For example, any member may be used as long as the member can regulate the sliding operation of the tray guide 40 at the first position.

Further, in the present embodiment, the sliding operation of the tray guide 40, which slides along the transporting direction of the tray T, is regulated, and then the tray guide 40 is held at the first position. Alternatively, in a tray guide, which is configured to be switched between a first position (a position for transporting the tray 1) and a second position (an acceptance position for opening the medium transporting path) through rotation, the same advantages as those in the above-described retainer can be obtained by regulating the rotation operation.

Next, a height regulator that regulates the heightwise position of the tray T from the tray supporting face 40*a* will be described with reference to FIGS. 29 and 31.

Figure 30:
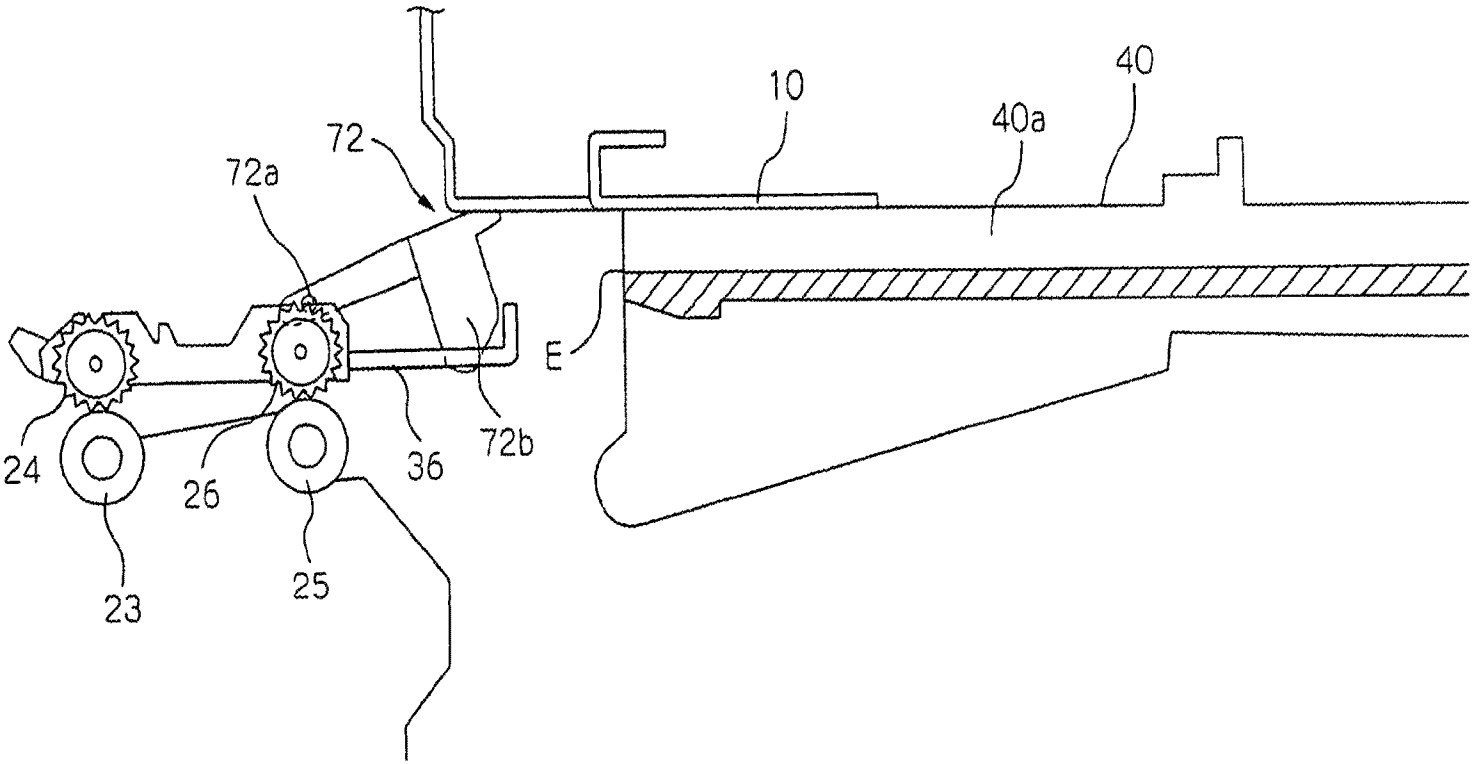
FIGS. 30 and 31 are views for explaining a regulating operation of the height regulator.
Figure 31:
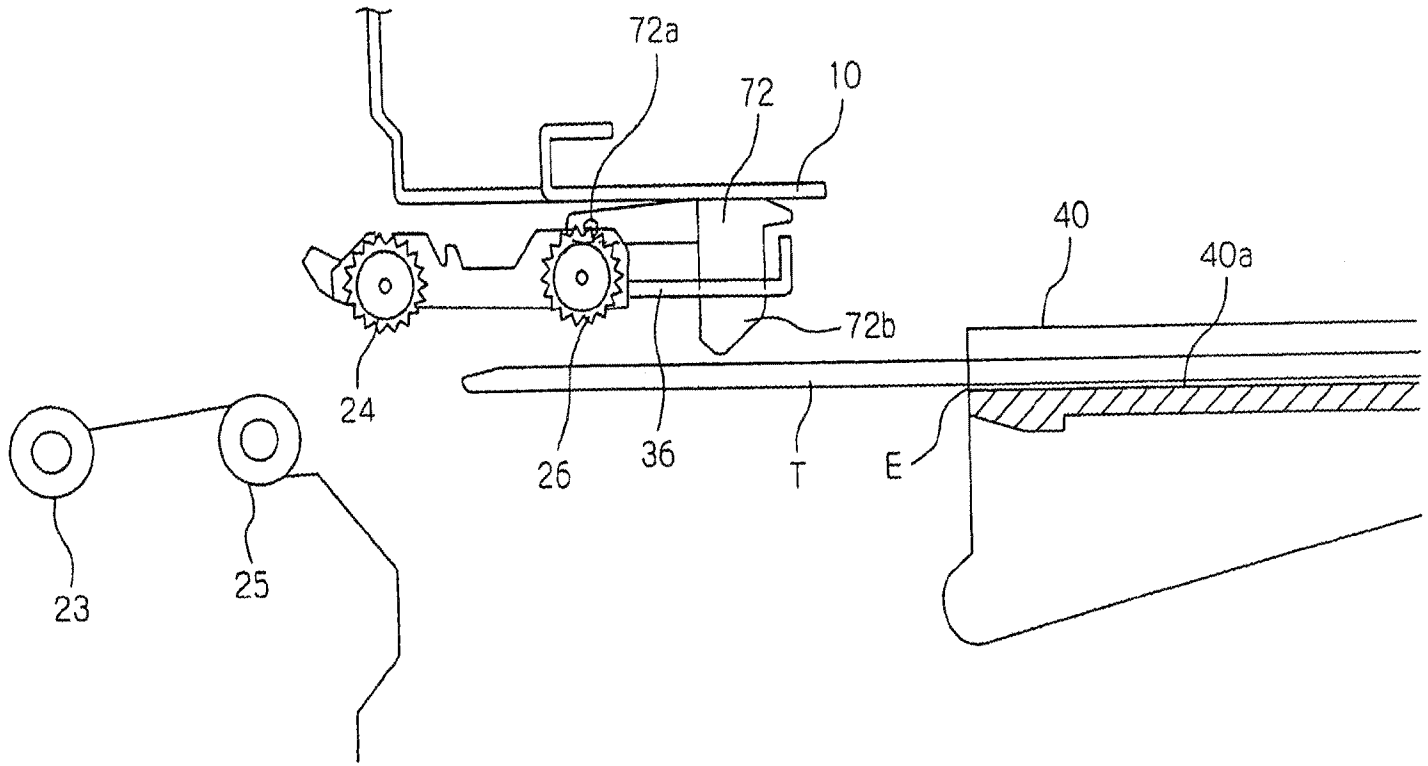

As shown in FIGS. 30 and 31, the height regulator 72 substantially has an L shape when the transporting path of the tray T is laterally viewed, and is provided in the roller supporting frame 36 to pivot about a rotary shaft 72*a*.

Further, the regulating member 72 is configured such that a regulating portion 72*b* having a shape protruding toward the transporting path of the tray T is provided to project from a hole formed in the roller supporting frame 36 below the roller supporting frame 36 (toward the medium transporting path), and is urged by a torsional coiled spring 73 to rotate in a direction not to project below the roller supporting frame 36.

Further, in the vicinity of the downstream side of the second driving roller 25, the main frame 10 is provided above the transporting path of the tray T (see FIG. 1), and thus the regulating member 72 engages with the main frame 10 so as to be switched between a non-projection state of the regulating portion 72*b* from the roller supporting frame 36 shown in FIG. 30 and a projection state shown in FIG. 31.

That is, FIG. 30 shows a state in which the tray guide 40 is at the second position, and the roller supporting frame 36 is at the contact position. In this state, however, since the roller supporting frame 36 is obliquely moved away from the main frame 10 in the downward direction, the regulating portion 72*b* of the regulating member 72 becomes the non-projection state in which the regulating portion 72*b* does not project below the roller supporting frame 36 by urging force of the torsional coiled spring 73.

On the other hand, as shown in FIG. 31, when the tray guide 40 is at the first position, and the roller supporting frame 36 is at the release position, the roller supporting frame 36 is displaced upward to be close to the main frame 10, and thus the regulating member 72 is pressed in the downward direction by the main frame 10. Accordingly, the regulating portion 72*b* projects below the roller supporting frame 36, that is, toward the transporting path of the tray T, and simultaneously becomes the projection state in which the regulating portion 72*b* slightly projects toward the transporting path of the tray T by the first follower roller 24 and the second follower roller 26. Moreover, in the projection state of the regulating member 72*b*, the regulating member 72*b* is disposed between the upstream-side end (which is denoted by reference numeral E) of the tray supporting face 40*a* in the tray guide 40 and the second follower roller 26.

With the regulating portion 72*b*, when the roller supporting frame 36, that is, the first follower roller 24 and the second follower roller 26, is at the contact position, the elevation of the tray T toward the first follower roller 24 and the second follower roller 26 is regulated.

Accordingly, the elevation of the tray T from the tray supporting face 40*a* can be reliably prevented, that is, the optical disc OD can be prevented from being brought into contact with the first follower roller 24 and the second follower roller 26, without increasing the longitudinal size of the tray T. That is, the optical disc OD can be reliably prevented from being brought into contact with the first follower roller 24 and the second follower roller 26, while preventing the installment space of the rear side of the apparatus from being increased.

In particular, in the present embodiment, the tray guide 40 slides horizontally along the transporting direction of the tray T. Accordingly, when the tray guide 40 is at the first position, the gap between the second follower roller 26 and the upstream-side end of the tray supporting face 40*a* may be easily made large. Therefore, for example, even when a cap is provided in the tray guide 40 so as to prevent the elevation of the tray T, the tray T may be easily elevated. However, since the regulating member 72 is provided between the second follower roller 26 and the upstream-side end of the tray supporting face 40*a*, even when the tray guide 40 is configured to slide in the transporting direction of the tray T, the elevation of the tray T can be reliably prevented.

Moreover, as shown in FIG. 31, in a state in which the tray T is supported on the tray supporting face 40*a*, a gap between the tray T and the regulating member 72 is formed such that the regulating member 72 is not brought into contact with the upper face of the tray T. Therefore, when the tray T is transported, a transport load does not occur.

Further, in the present embodiment, the regulating member 72 is provided in the vicinity of the downstream side of the second follower roller 26, and thus the following advantages are obtained. That is, after the tray T is set on the tray guide 40, and the front end of the tray T is nipped by the driving roller 20 and the follower roller 21, the tray T is difficult to be elevated from the tray supporting face 40*a*. At this time, however, if the portion of the tray T protruding from the tray supporting face 40*a* toward the front side of the apparatus is compulsively pressed in the downward direction, the tray T is curved upward.

Here, if the regulating member 72 is provided on the upstream side of the first follower roller 24, before the curved tray T comes into contact with the regulating member 72, the optical disc OD set on the tray T may be brought into contact with the first follower roller 24 or the second follower roller 26. In the present embodiment, however, since the regulating member 72 is provided on the downstream side of the second follower roller 26, even when the tray T is curved upward, the tray T or the optical disc OD comes into contact with the regulating member 72, before the optical disc OD set on the tray T is brought into contact with the first follower roller 24 or the second follower roller 26. Accordingly, the optical disc OD set on the tray T can be reliably protected.

Further, in the present embodiment, the regulating member 72 is plurally provided in the widthwise direction of the tray T, as shown in FIG. 29, and thus the optical disc OD can be more reliably prevented from being brought into contact with the first follower roller 24 and the second follower roller 26. Further, the posture of the tray T can be further stabilized.

In addition, in the present embodiment, since the regulating members 72 are provided at a position distant from the optical disc OD set on the tray T, more specifically, at positions corresponding to peripheries of both side ends of the tray T. Therefore, the optical disc OD can be prevented from being brought into contact with the first follower roller 24 and the second follower roller 26, without damaging the optical disc OD set on the tray T.

In addition, as described above, the regulating member 72 is configured to project toward the transporting path of the tray T when the first follower roller 24 and the second follower roller 26 are at the contact positions, and to be moved away from (not to project below the roller supporting frame 36) the transporting path of the tray T when the first follower roller 24 and the second follower roller 26 are at the release position. Therefore, when recording is performed on the paper P, the paper P can be smoothly ejected, without being interrupted by the regulating member 72.

Although the invention is described in its preferred from with a certain degree of particularity, obviously many changes and variations are possible therein. It is therefore to be understood that the present invention may be practiced than as specifically described herein without departing from scope and spirit thereof.

The invention claimed is:

1. A liquid ejecting apparatus, comprising:

a paper feeding tray on which a paper is set;

a recording head;

a paper receiving portion, configured to receive the paper on which a recording is performed by the recording head;

a pair of feeding rollers disposed at a side of the paper feeding tray with respect to the recording head;

a pair of ejecting rollers disposed at a side of the paper receiving portion with respect to the recording head;

a medium tray, on which a recording medium is set, and configured to be inserted from a side of the ejecting rollers; and a moving member, configured to move from be moved between a first position to and a second position, to be placed at the second position for prohibiting the medium tray from being inserted from the side of the ejecting rollers in a first recording mode, and to be placed at the first position to allow the medium tray to be inserted from the side of the ejecting rollers in a second recording mode, wherein, in the first recording mode, the paper is fed to the feeding roller from the paper feeding tray, the recording is performed on the paper by the recording head, and the paper is ejected to the paper receiving portion through the ejecting rollers, wherein, in the second recording mode, the medium tray is fed to the ejecting rollers from the feeding rollers and the recording is performed on the recording medium set on the medium tray by the recording head, after the medium tray is inserted from the side of the ejecting rollers and the recording medium set on the medium tray passes the recording head, and wherein the first position of the moving member is a position displaced from the second position in a first direction which is defined as a direction toward a side of the paper receiving portion from a side of the recording head, and wherein the ejecting rollers placed at separated positions where the ejecting rollers are separated from each other move to contact positions where the ejecting rollers contact each other interlockingly with a movement of the moving member from the first position to the second position, and the ejecting rollers placed at the contact positions move to the separated positions interlockingly with a movement of the moving member from the second position to the first position.

2. The liquid ejecting apparatus according to claim 1, further comprising: a position sensor configured to detect whether the moving member is placed at either the first position and the second position.

3. The liquid ejecting apparatus according to claim 1, wherein the paper set on the feeding tray is fed to the feeding rollers after being reversed.

4. The liquid ejecting apparatus according to claim 3, further comprising another feeding tray, wherein a paper set on the another feeding tray is fed to the feeding rollers without being reversed.

5. The liquid ejecting apparatus according to claim 1, wherein the moving member includes a plate-shaped portion.

6. The liquid ejecting apparatus according to claim 1, wherein the moving member has a plate shape.

7. A liquid ejecting apparatus, comprising:

a paper feeding tray on which a paper is set;

a recording head;

a paper receiving portion, configured to receive the paper on which a recording is performed by the recording head;

a pair of feeding rollers disposed at a side of the paper feeding tray with respect to the recording head;

a pair of ejecting rollers disposed at a side of the paper receiving portion with respect to the recording head;

a medium tray, on which a recording medium is set, and configured to be inserted from a side of the ejecting rollers; and a moving member, disposed above the paper receiving portion, configured to be moved between a first position to a second position, to be placed at the second position for prohibiting the medium tray from being inserted from the side of the ejecting rollers in a first recording mode, and to be placed at the first position to allow the medium tray to be inserted from the side of the ejecting rollers in a second recording mode, wherein, in the first recording mode, the paper is fed to the feeding roller from the paper feeding tray, the recording is performed on the paper by the recording head, and the paper is ejected to the paper receiving portion through the ejecting rollers, wherein, in the second recording mode, the medium tray is fed to the ejecting rollers from the feeding rollers and the recording is performed on the recording medium set on the medium tray by the recording head, after the medium tray is inserted from the side of the ejecting rollers and the recording medium set on the medium tray passes the recording head, and wherein the first position of the moving member is a position displaced from the second position in a first direction which is defined as a direction toward a side of the paper receiving portion from a side of the recording head, and wherein, when seen from a direction perpendicular to the first direction, a first distance from an upper face of the moving member to the paper receiving portion in the first recording mode is larger than a second distance between the upper face of the moving member to the paper receiving portion in the second recording mode.

* * * * *